US012213517B2

(12) United States Patent
Fuisz et al.

(10) Patent No.: US 12,213,517 B2
(45) Date of Patent: Feb. 4, 2025

(54) VAPORIZER FOR SMOKING CIGARETTES WITH INDIVIDUAL HEATER

(71) Applicant: Sobota HnB Technologies LLC, Nashville, TN (US)

(72) Inventors: Joseph M. Fuisz, Nashville, TN (US); Richard C. Fuisz, Nashville, TN (US); Volodymyr Smolkin, Zhytomyr (UA)

(73) Assignee: Sobota HnB Technologies LLC, Nashville, TN (US)

( * ) Notice: Subject to any disclaimer, the term of this patent is extended or adjusted under 35 U.S.C. 154(b) by 28 days.

(21) Appl. No.: 17/306,408

(22) Filed: May 3, 2021

(65) Prior Publication Data

US 2022/0218023 A1 Jul. 14, 2022

Related U.S. Application Data

(63) Continuation-in-part of application No. 17/148,014, filed on Jan. 13, 2021, now Pat. No. 11,076,642.

(51) Int. Cl.

| | |
|---|---|
| ***A24F 40/20*** | (2020.01) |
| ***A24F 40/46*** | (2020.01) |
| ***A24F 40/60*** | (2020.01) |

(52) U.S. Cl.

CPC ..... *A24F 40/20* (2020.01); *A24F 40/46* (2020.01); *A24F 40/60* (2020.01)

(58) Field of Classification Search

None

See application file for complete search history.

(56) References Cited

U.S. PATENT DOCUMENTS 5,144,962 A 9/1992 Counts et al.
5,865,185 A * 2/1999 Collins ..... A24D 3/17 131/194

(Continued)

FOREIGN PATENT DOCUMENTS

CA 2875632 A1 * 12/2013 ..... A24F 47/008
CN 204335821 U * 5/2015 ..... A24B 15/167

(Continued)

OTHER PUBLICATIONS

International Search Report dated May 23, 2022 in counterpart Appln. No. PCT/US22/12084.

(Continued)

*Primary Examiner* — Xiao S Zhao
*Assistant Examiner* — Guy F Mongelli
(74) *Attorney, Agent, or Firm* — FITCH, EVEN, TABIN & FLANNERY LLP

(57) ABSTRACT

A vaporizer is configured to be used for vaping a botanical stick having at least one individual resistive heater and contacts to the at least one resistive heater. The vaporizer includes a housing, a battery compartment configured to hold a battery in the housing, an electronic control and power unit provided in the housing, and a cover movable between an open position exposing a compound chamber within the housing and a closed position connected to the housing and closing a portion of the compound chamber. The compound chamber is configured to hold at least the portion of the botanical stick having the contacts. Contacts are provided in the compound chamber and are configured to create an electrical connection between the electronic control and power unit and contacts on the botanical stick when the botanical stick has been inserted into the compound chamber.

16 Claims, 25 Drawing Sheets

(56) References Cited

U.S. PATENT DOCUMENTS

| | | | | |
|---|---|---|---|---|
| 11,076,642 | B1 * | 8/2021 | Fuisz | A24F 40/40 |
| 2002/0005207 | A1 | 1/2002 | Wrenn et al. | |
| 2005/0016549 | A1 | 1/2005 | Banerjee et al. | |
| 2007/0045288 | A1 * | 3/2007 | Nelson | A61M 11/041 219/533 |
| 2007/0074734 | A1 * | 4/2007 | Braunshteyn | A24F 40/51 131/194 |
| 2007/0089757 | A1 | 4/2007 | Bryman | |
| 2008/0121244 | A1 | 5/2008 | Bryman | |
| 2010/0024834 | A1 * | 2/2010 | Oglesby | A24F 42/60 131/194 |
| 2011/0147486 | A1 | 6/2011 | Greim et al. | |
| 2012/0272977 | A1 | 11/2012 | Le Roux | |
| 2013/0032158 | A1 | 2/2013 | Garrett et al. | |
| 2013/0319438 | A1 * | 12/2013 | Liu | A24F 40/485 131/329 |
| 2014/0000638 | A1 * | 1/2014 | Sebastian | A24F 40/50 131/328 |
| 2014/0230834 | A1 | 8/2014 | Kaljura et al. | |
| 2014/0261492 | A1 * | 9/2014 | Kane | A24F 40/485 131/328 |
| 2014/0305449 | A1 | 10/2014 | Plojoux et al. | |
| 2015/0053217 | A1 * | 2/2015 | Steingraber | A24F 40/50 131/329 |
| 2015/0136154 | A1 * | 5/2015 | Mitrev | A24D 1/20 131/328 |
| 2016/0174611 | A1 * | 6/2016 | Monsees | A24F 40/50 392/386 |
| 2016/0302488 | A1 * | 10/2016 | Fernando | A24F 40/51 |
| 2016/0310684 | A1 | 10/2016 | McCullough | |
| 2016/0324215 | A1 * | 11/2016 | Mironov | A61M 15/0011 |
| 2016/0360785 | A1 * | 12/2016 | Bless | A24F 40/53 |
| 2017/0006922 | A1 * | 1/2017 | Wang | H05B 3/46 |
| 2017/0035116 | A1 * | 2/2017 | Batista | A24F 40/42 |
| 2017/0258135 | A1 * | 9/2017 | Yerkic-Husejnovic | A24F 40/95 |
| 2018/0084823 | A1 | 3/2018 | Fuisz et al. | |
| 2018/0168224 | A1 * | 6/2018 | Naughton | A24F 40/46 |
| 2018/0214645 | A1 * | 8/2018 | Reevell | A24F 40/53 |
| 2019/0208816 | A1 * | 7/2019 | Thorsen | A24F 40/46 |
| 2019/0274354 | A1 | 9/2019 | Sur et al. | |
| 2019/0387806 | A1 * | 12/2019 | Nakano | A24F 40/50 |
| 2020/0035119 | A1 * | 1/2020 | Pandolfino | G09B 19/00 |
| 2020/0154789 | A1 | 5/2020 | Novak, III et al. | |
| 2022/0039465 | A1 * | 2/2022 | Du | A24F 40/30 |
| 2022/0272797 | A1 * | 8/2022 | Moloney | A24F 40/20 |

FOREIGN PATENT DOCUMENTS

| | | | | |
|---|---|---|---|---|
| CN | 108601405 | A * | 9/2018 | A24B 15/167 |
| CN | 109068738 | A * | 12/2018 | A24D 3/061 |
| WO | WO-2016120177 | A1 * | 8/2016 | A24B 15/167 |
| WO | WO-2018202732 | A1 * | 11/2018 | A24F 15/01 |
| WO | 2020/070109 | A1 | 4/2020 | |

OTHER PUBLICATIONS

Supplementary Partial Search Report dated Nov. 12, 2024 in EP App. No. 22739960.7.

* cited by examiner

VAPORIZER FOR SMOKING CIGARETTES WITH INDIVIDUAL HEATER

This application is a continuation-in-part application of U.S. patent application Ser. No. 17/148,014, filed Jan. 13, 2021.

TECHNICAL FIELD

The presently disclosed subject matter relates generally to vaping systems, heat not burn systems, tobacco sticks, devices and methods of use thereof.

BACKGROUND OF THE INVENTION

Heat-not-burn systems are increasingly well known in the field and there are a number of marketed products to-date. Such products include, for example, Philip Morris International's IQOS® system. The IQOS® system employs a special tobacco cigarette or tobacco stick (often marketed as Heets®) which is inserted into a cylindrical device top side (tobacco containing side first, with filter end up). The special cigarette is impaled upon a heat blade when inserted. The heat blade heats the cigarette in order to aerosolize components that may then be inhaled by the user. A warm-up stage is required prior to inhalation, to bring the heat blade and tobacco portion to operating temperatures.

As another example, British American Tobacco sells a competing heat-not-burn system marketed as GLO™. With GLO™, the special cigarette is inserted into a cylindrical opening in a larger handheld device, again, top (tobacco containing side) side first and filter side up. Unlike IQOS®, the GLO™ special cigarette is not impaled on a heat blade, but rather is heated from a heating system in the handheld device that surrounds the cylindrical opening.

Other companies offer competing products that employ comparable physical architectures; for example, Korea Tobacco's LiI™ heat-not-burn system.

BRIEF SUMMARY OF THE INVENTION

The invention relates to heat-not-burn systems, including devices such as vaporizers which comprise heat-not-burn systems (also referred to herein as device/s).

The invention also relates to sticks (also referred to herein as special tobacco cigarette/s or tobacco stick/s) for heat-not-burn systems.

One aspect of the present invention relates to a vaporizer configured to be used for vaping a botanical stick having at least one individual resistive heater and contacts to the at least one resistive heater, at least a portion of the tobacco stick having the contacts to be provided within the vaporizer. The vaporizer includes a housing, a battery compartment configured to hold a battery in the housing, an electronic control and power unit provided in the housing, and a cover movable between an open position exposing a compound chamber within the housing and a closed position connected to the housing and closing a portion of the compound chamber. The compound chamber is configured to hold at least the portion of the botanical stick having the contacts. Contacts are provided in the compound chamber and are configured to create an electrical connection between the electronic control and power unit and contacts on the botanical stick when the botanical stick has been inserted into the compound chamber.

Another aspect of the present invention relates to a vaporizer configured to be used for vaping a botanical stick to be provided within the vaporizer. The vaporizer includes a housing, a battery compartment configured to hold a battery in the housing, an electronic control and power unit provided in the housing, and a cover movable between an open position exposing a compound chamber within the housing and a closed position connected to the housing and closing a portion of the compound chamber. The compound chamber is configured to hold at least the portion of the botanical stick having the contacts. At least one resistive heater, typically contained in or as part of the botanical stick itself, is provided in the compound chamber and electrically connected to the electronic control and power unit. The resistive heater is configured to contact the botanical stick when the botanical stick has been inserted into the compound chamber at least when the cover is in the closed position.

A further aspect of the present invention relates to a botanical stick including a botanical substrate and at least one individual resistive heater provided within and/or around the botanical substrate or around the botanical stick tipping paper (or other material comprising the exterior of the botanical stick). The botanical stick may comprise a cigarette.

BRIEF DESCRIPTION OF THE DRAWINGS

Figure 1:
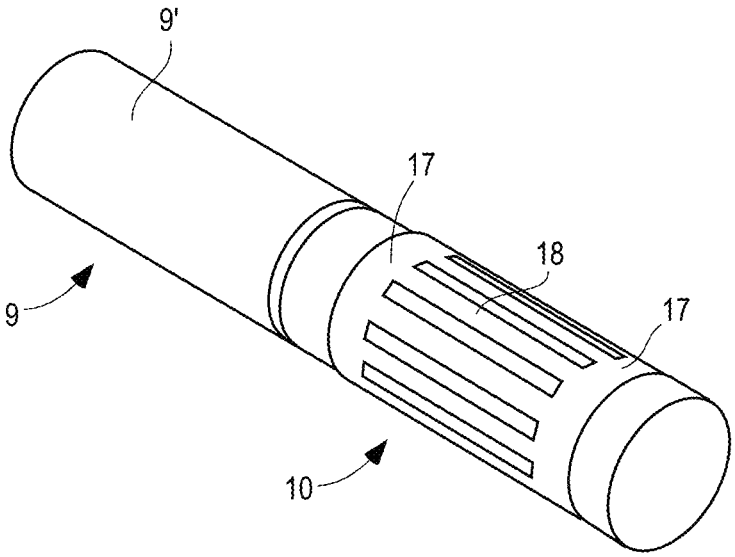
Figure 2:
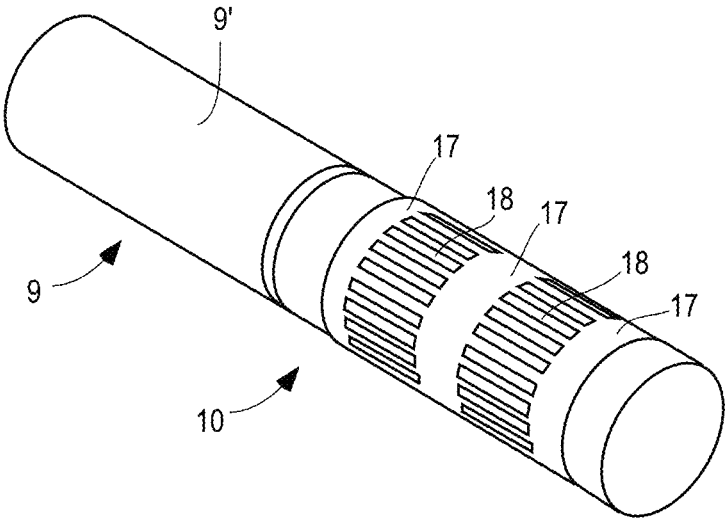
Figure 3:
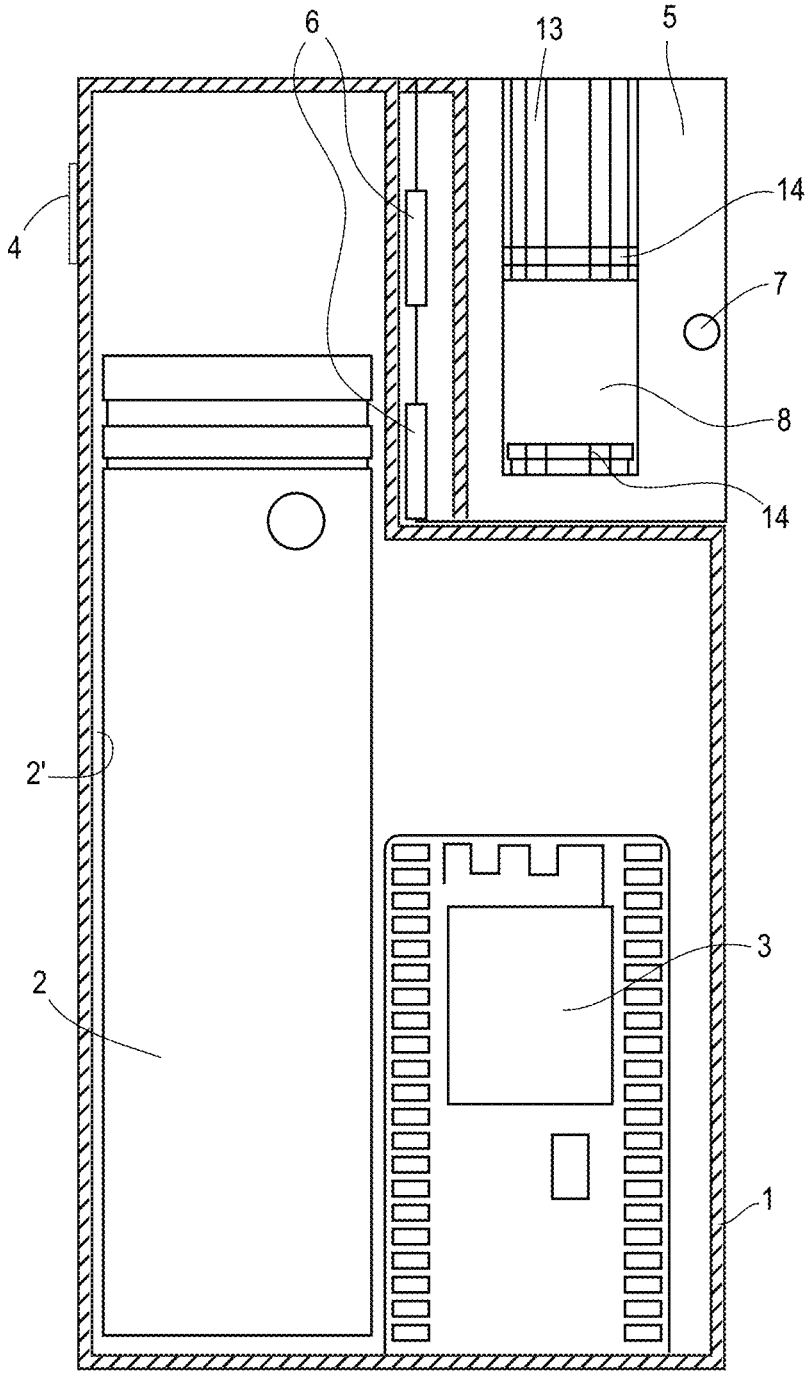
Figure 4:
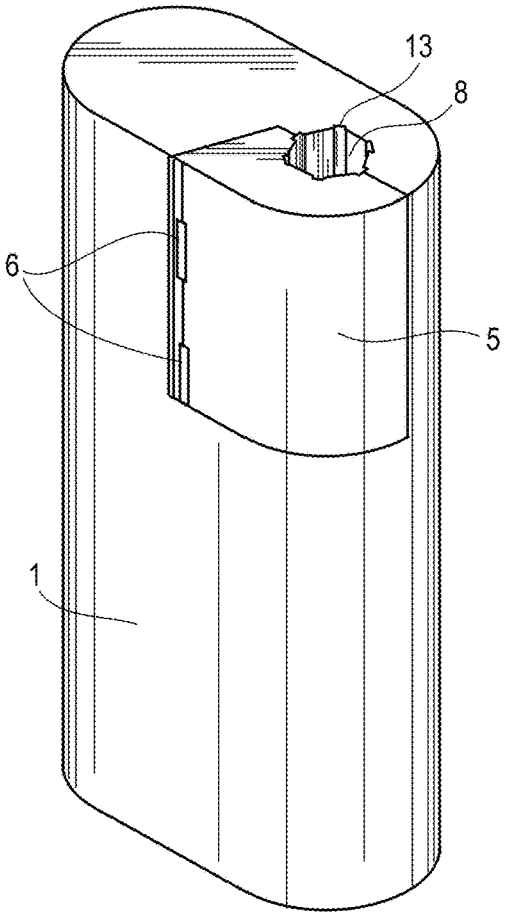
Figure 5:
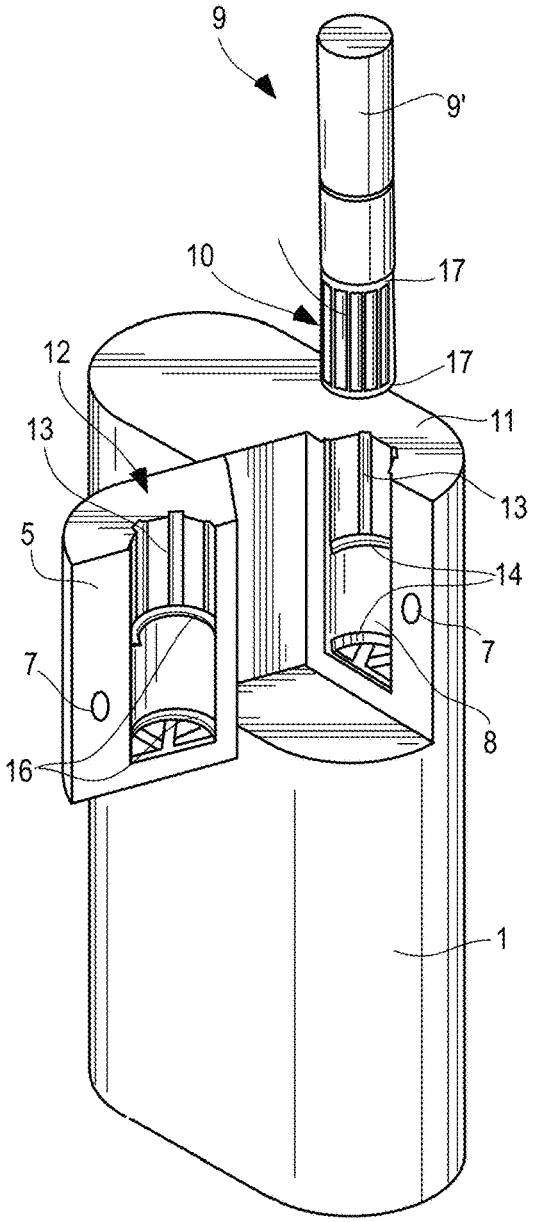
Figure 6:
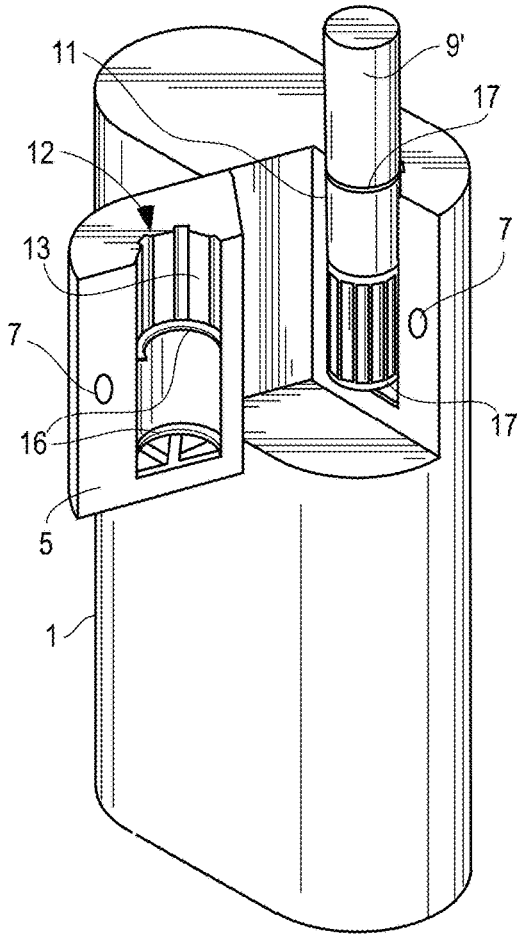
Figure 7:
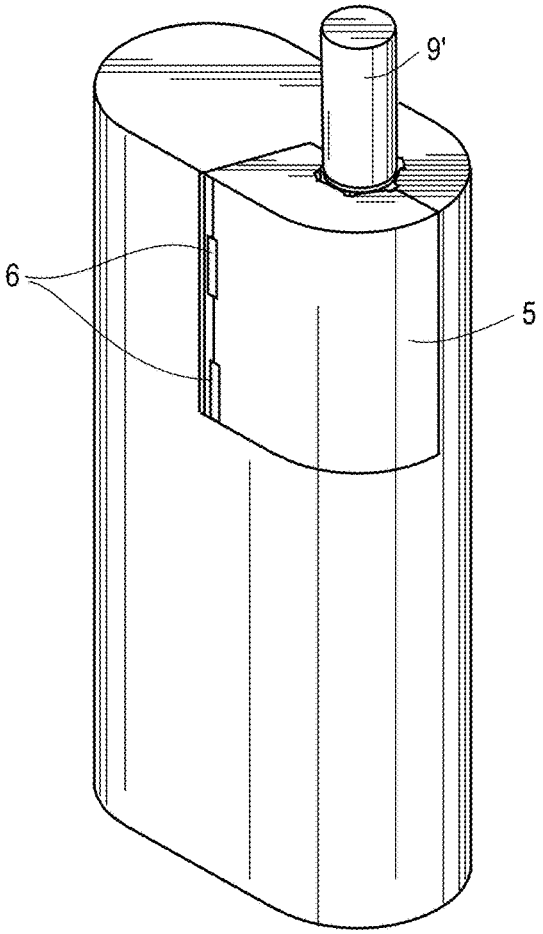
Figure 8:
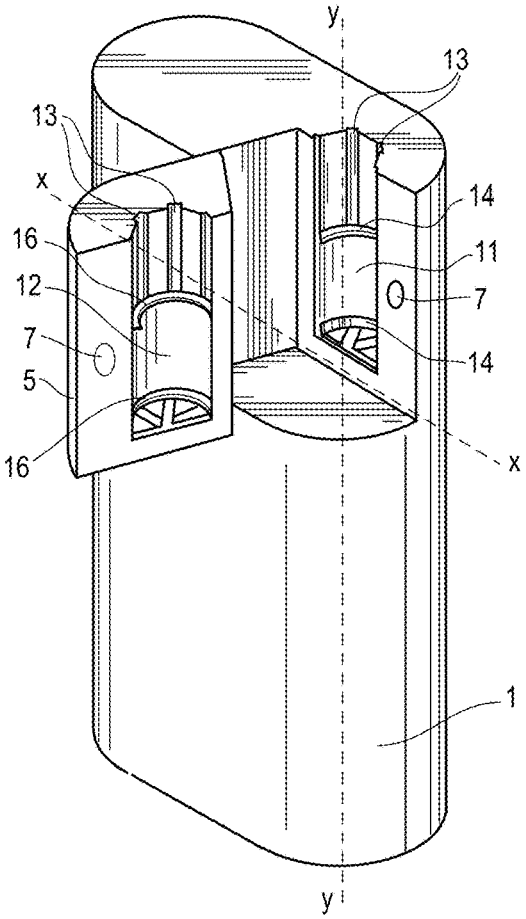
Figure 9:
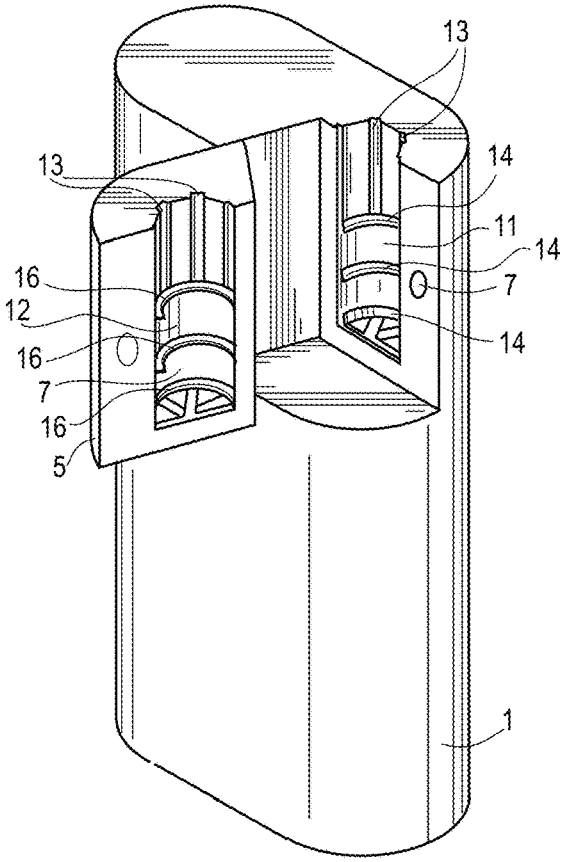
Figure 10:
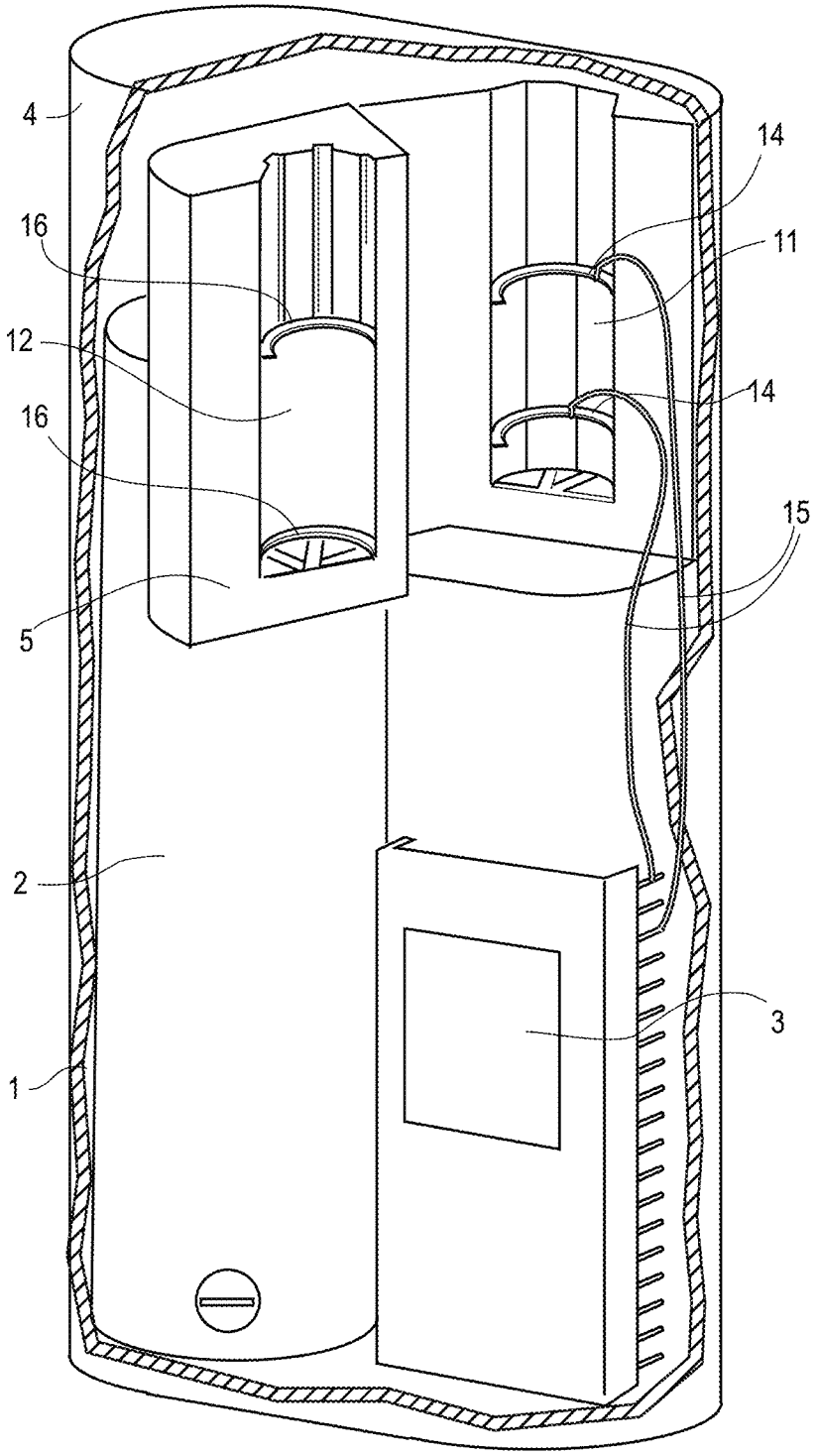
Figure 11:
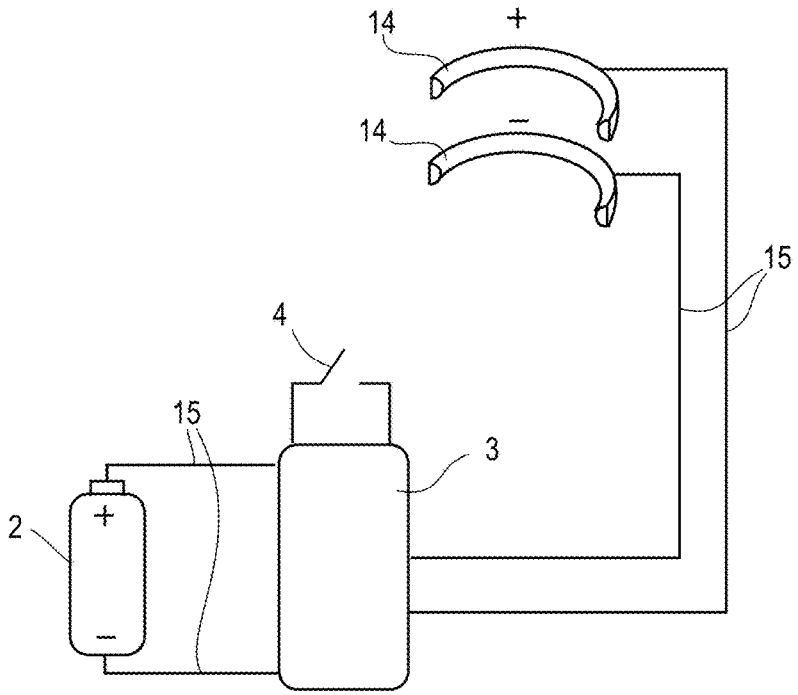
Figure 12:
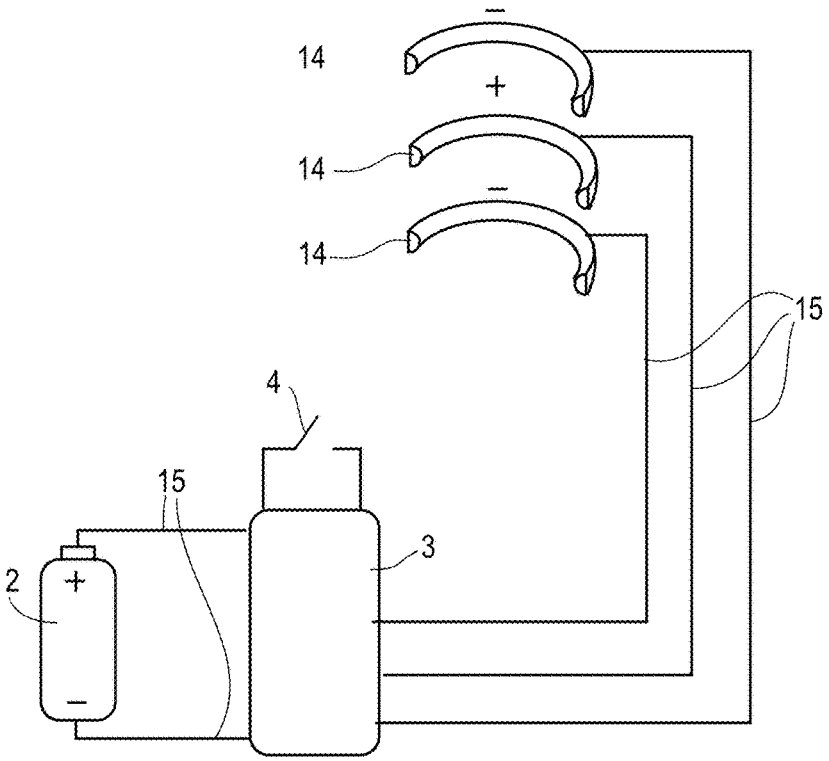
Figure 13:
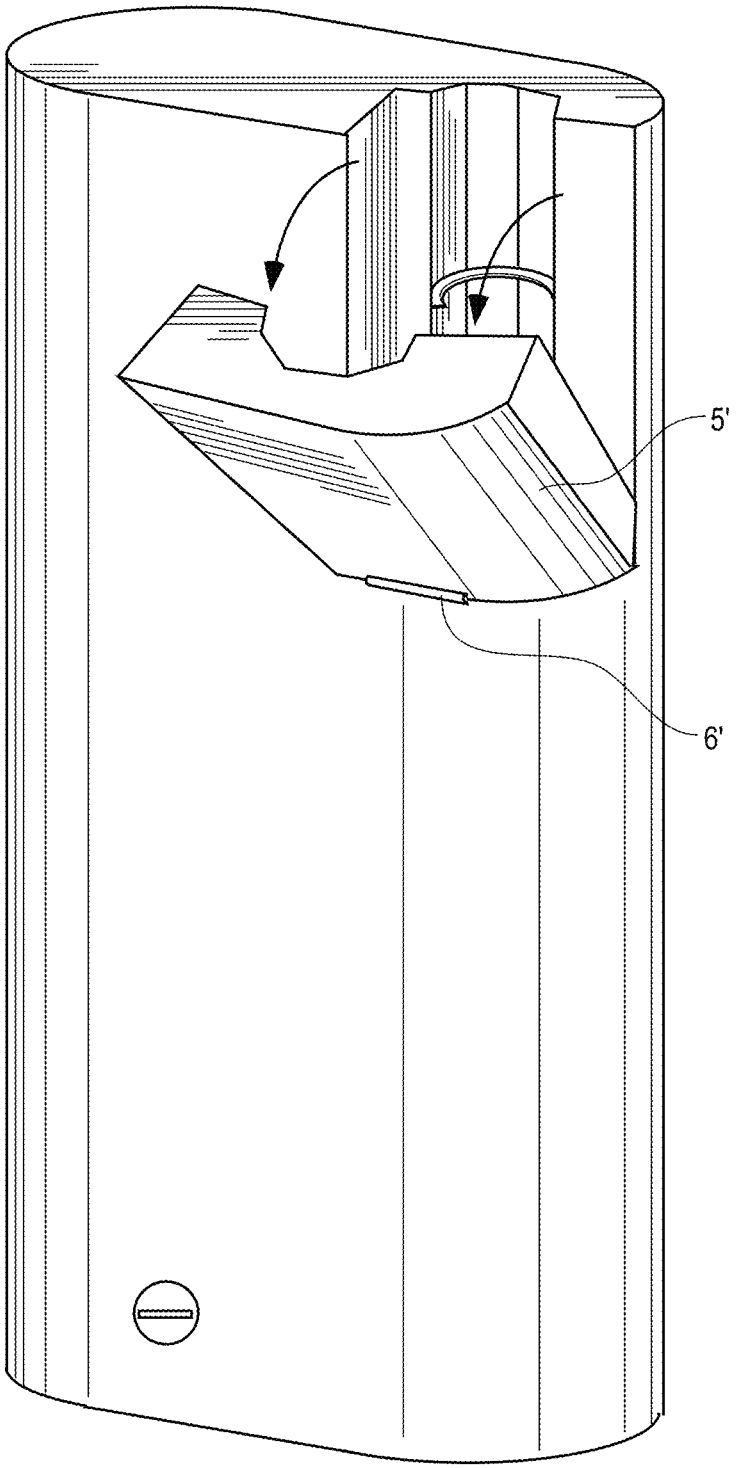
Figure 14:
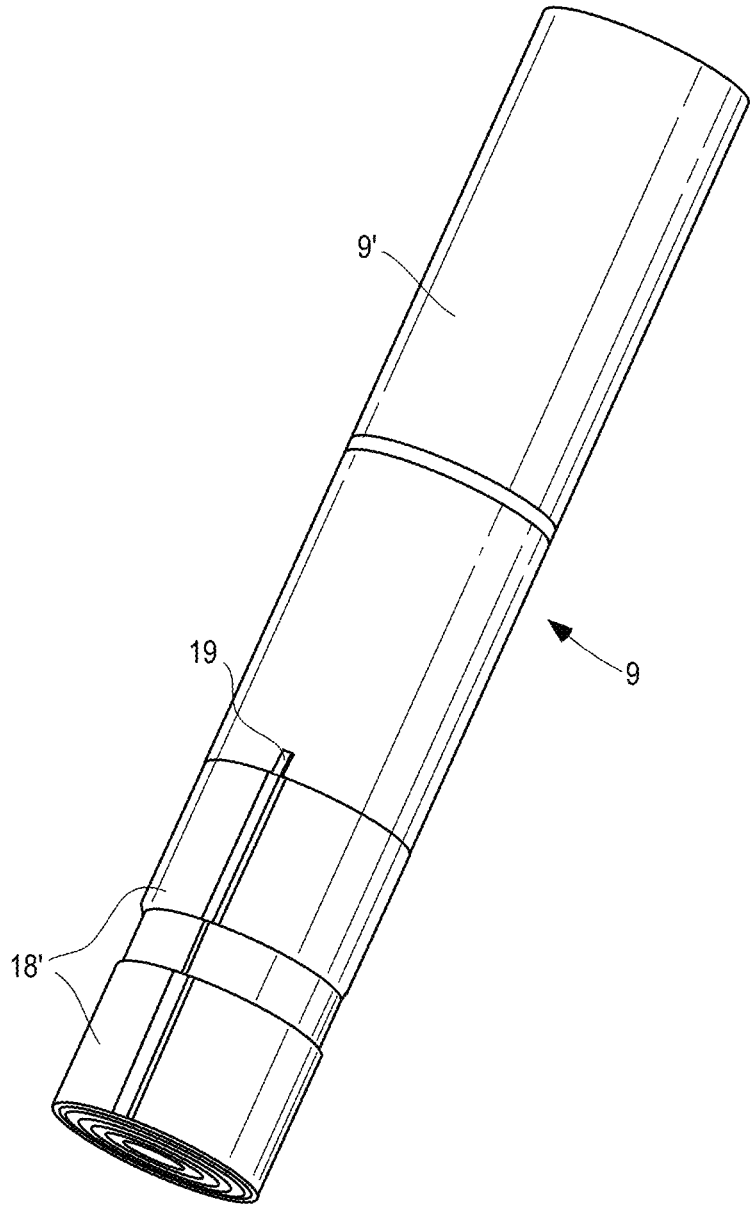
Figure 15:
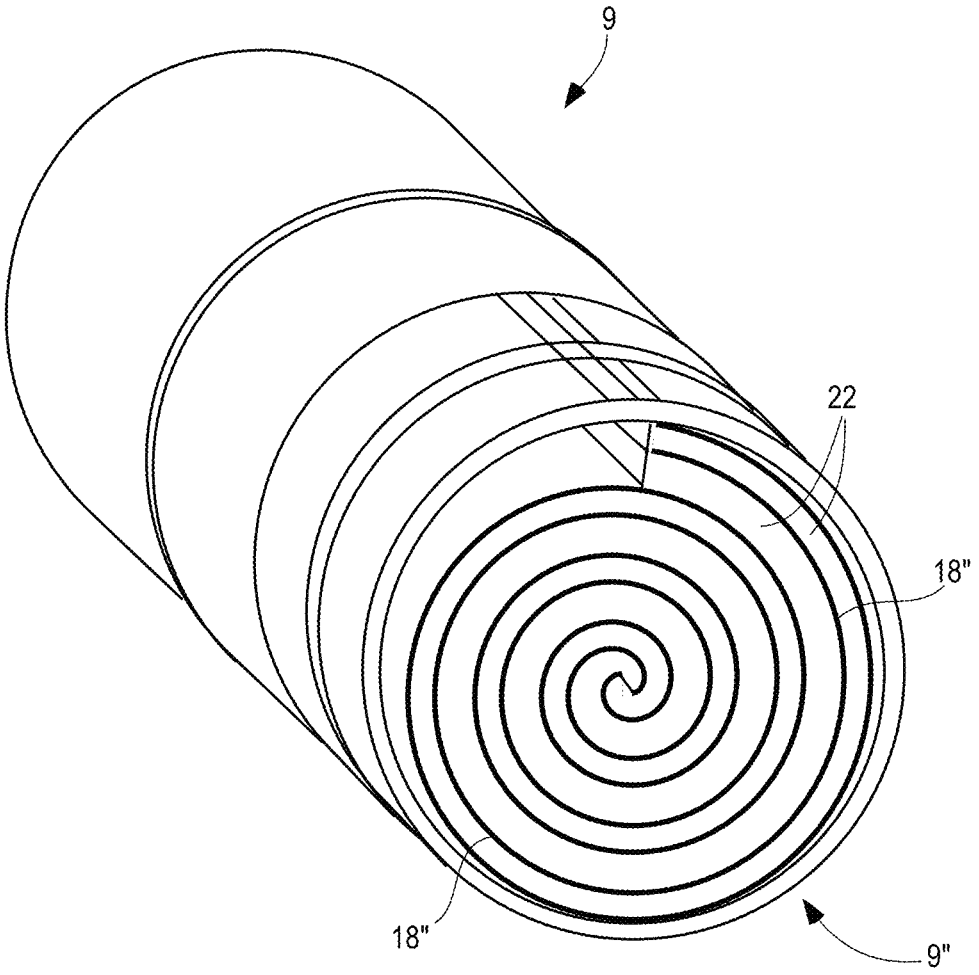

Having thus described the presently disclosed subject matter in general terms, reference will now be made to the accompanying Drawings, which are not necessarily drawn to scale, and wherein:

FIG. 1 illustrates an embodiment (embodiment 1) of a tobacco stick comprising an individual heating element, which is implemented with two contact rings and with one heating surface between them;

FIG. 2 illustrates another embodiment (embodiment 2) of a tobacco stick comprising an individual heating element, which is implemented with three contact rings and two heating surfaces between them;

FIG. 3 illustrates a longitudinal section of a vaporizer for smoking tobacco sticks where such tobacco sticks comprise an individual heater;

FIG. 4 illustrates a vaporizer for smoking tobacco sticks comprising an individual heater, with the closed flip cover, without a cigarette inside;

FIG. 5 illustrates a vaporizer for smoking tobacco sticks comprising an individual heater, with the open flip cover, before the installation of a cigarette;

FIG. 6 illustrates a vaporizer for smoking tobacco sticks comprising an individual heater, with the open flip cover, with a cigarette inside;

FIG. 7 illustrates a vaporizer for smoking tobacco sticks comprising an individual heater, with the closed flip cover, with a cigarette inside;

FIG. 8 illustrates a vaporizer for smoking tobacco sticks comprising an individual heater, with an open flip cover, with two active contact semi-rings in the body part of the compound chamber, and with two passive contact semi-rings in the flip cover part of the compound chamber, and illustrating an x and y axis;

FIG. 9 illustrates a vaporizer for smoking tobacco sticks comprising an individual heater, with an open flip cover (rotates horizontally), with three active contact semi-rings in the body part of the compound chamber, and with three passive contact semi-rings in the flip cover part of the compound chamber;

FIG. 10 illustrates a vaporizer for smoking tobacco sticks comprising an individual heater, with an open flip cover, with two active contact semi-rings in the body part of the compound chamber, which are connected to the battery through the control button and the electronic control and power unit and with two passive contact semi-rings in the flip cover part of the compound chamber;

FIG. 11 illustrates a flowchart of a vaporizer for smoking tobacco sticks comprising an individual heater and with two active contact semi-rings in the body part of the compound chamber;

FIG. 12 illustrates a flowchart of a vaporizer for smoking tobacco sticks comprising an individual heater and with three active contact semi-rings in the body part of the compound chamber;

FIG. 13 illustrates another embodiment of a vaporizer for smoking tobacco sticks comprising an individual heater with the flip cover open, featuring a flip cover which rotates vertically;

FIG. 14 illustrates yet another embodiment of a tobacco stick comprising a visual indicator for the removable installment of the tobacco stick in the compound chamber and two ring-like individual resistive heaters (heating elements);

FIG. 15 illustrates a tobacco stick in from the tobacco-containing end.

Figure 16:
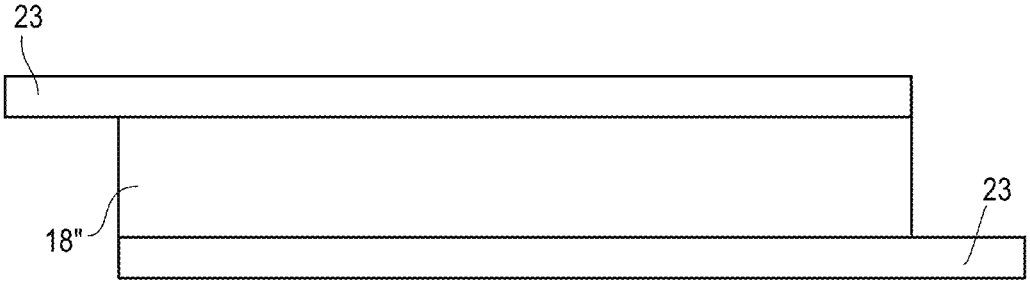

FIG. 16 illustrates a strip heater for the tobacco stick, in unrolled, flattened perspective.

Figure 17:
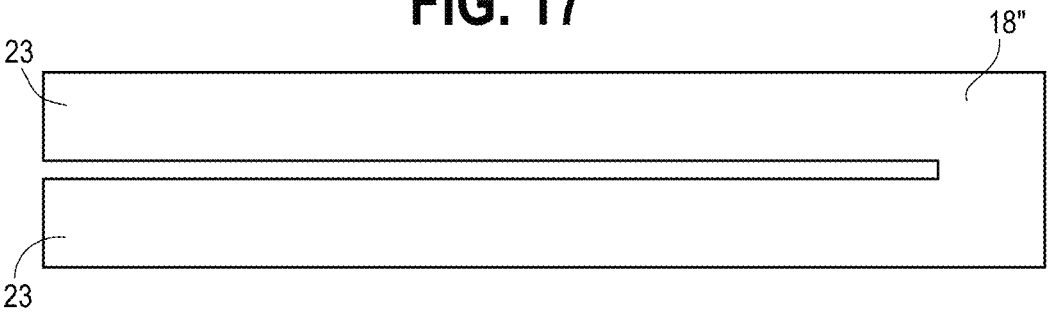

FIG. 17 illustrates a strip heater for the tobacco stick, in unrolled, flattened perspective.

Figure 18:
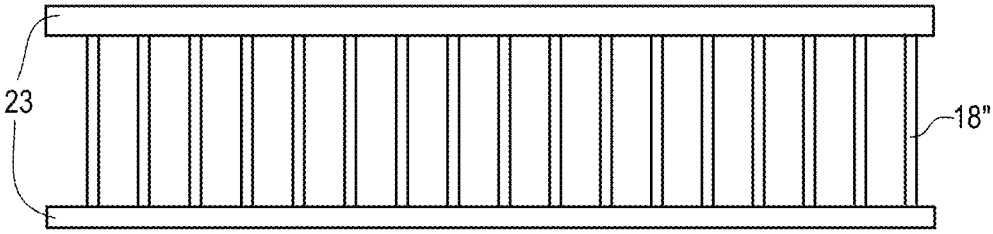
Figure 19:
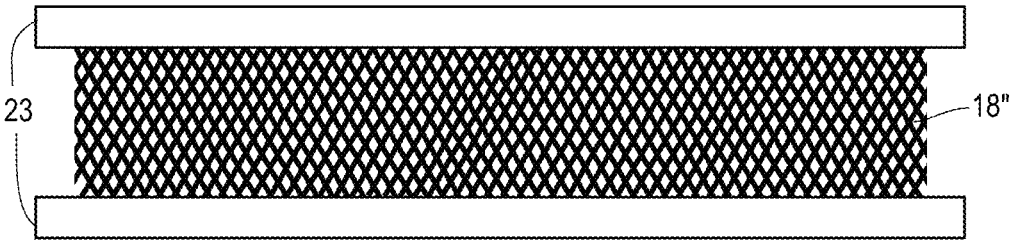
Figure 20:
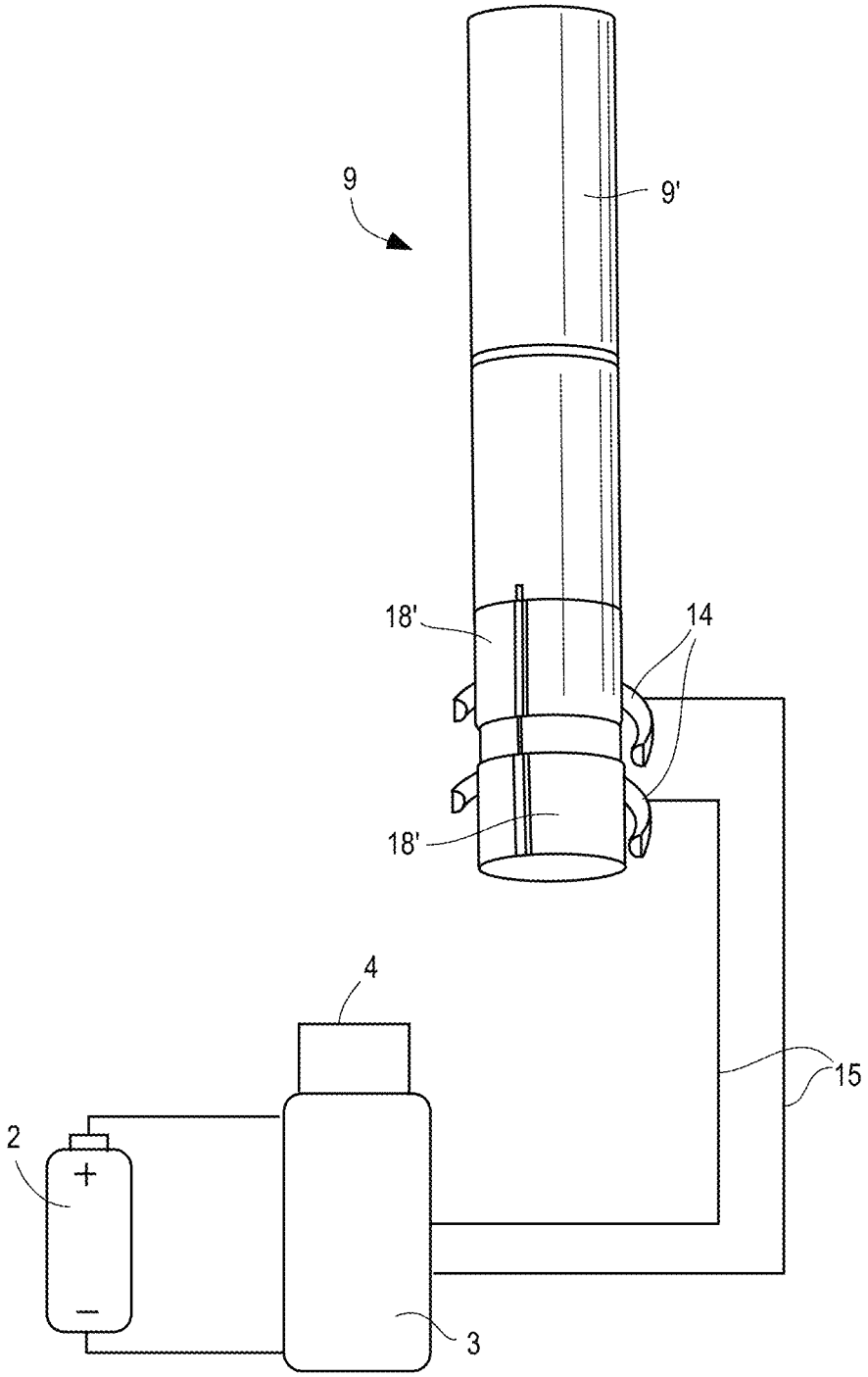
Figure 21:
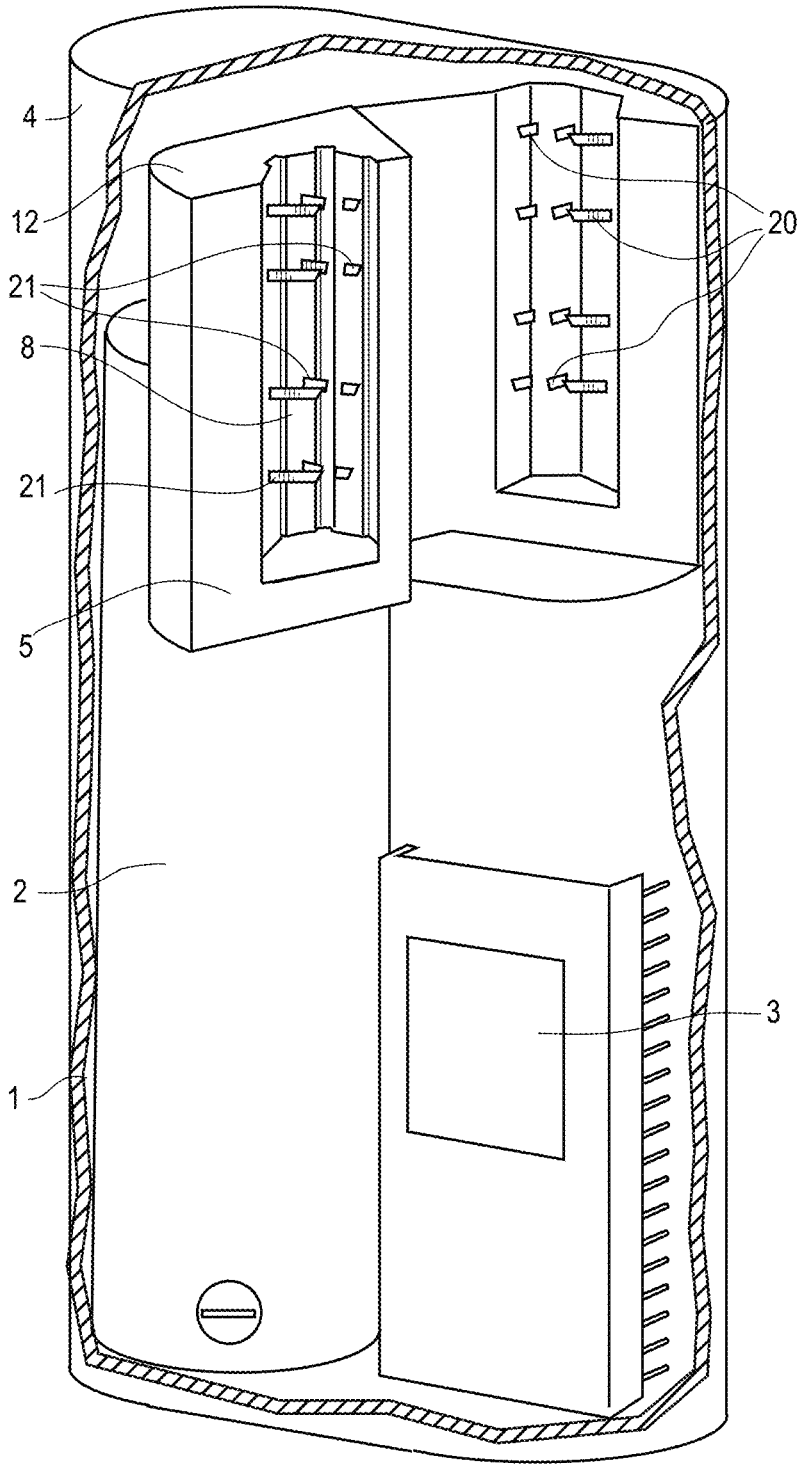
Figure 22:
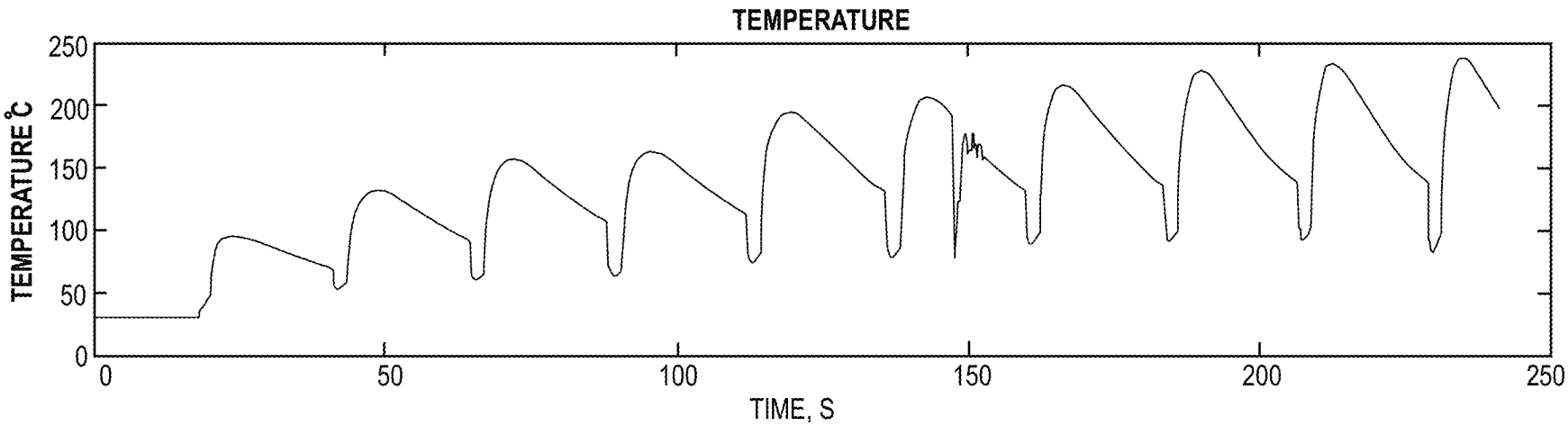
Figure 23:
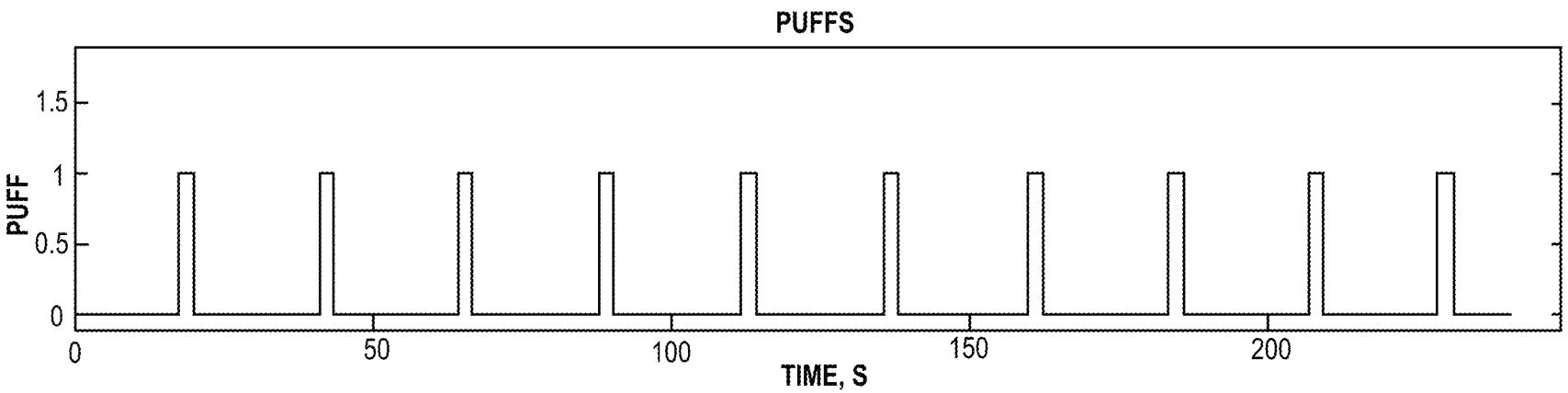
Figure 24:
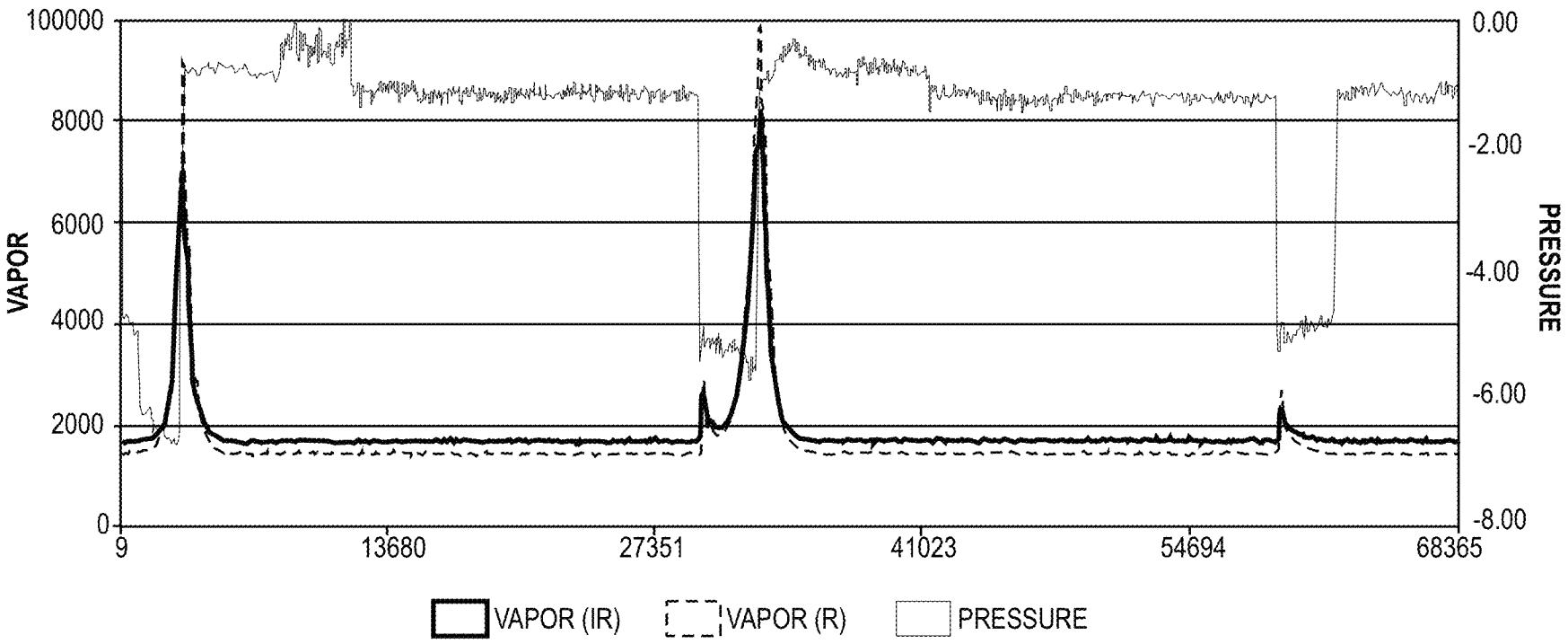
Figure 25:
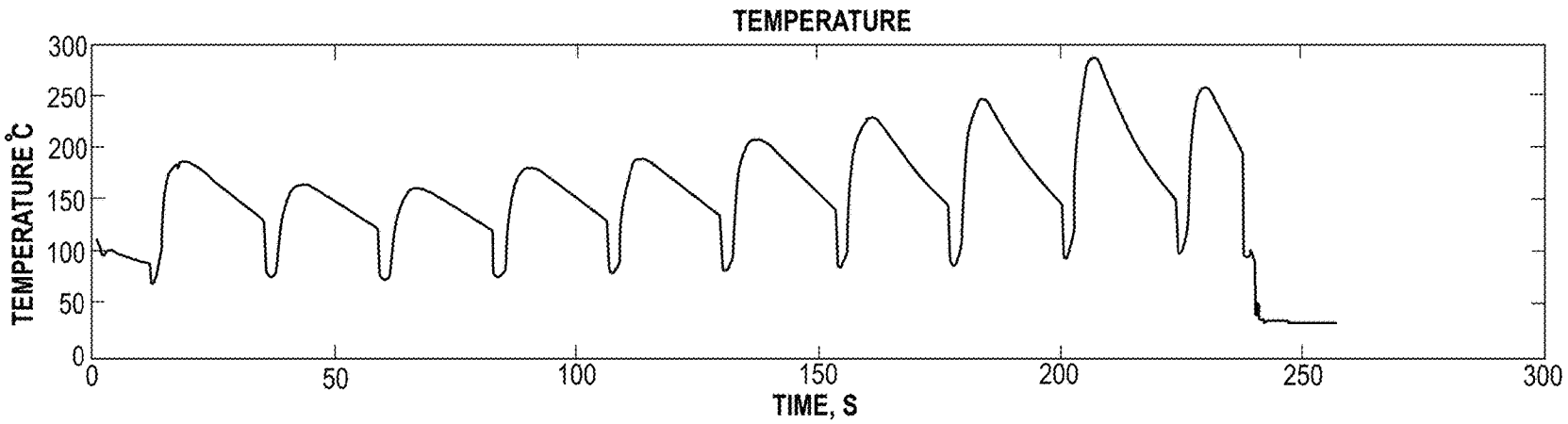
Figure 26:
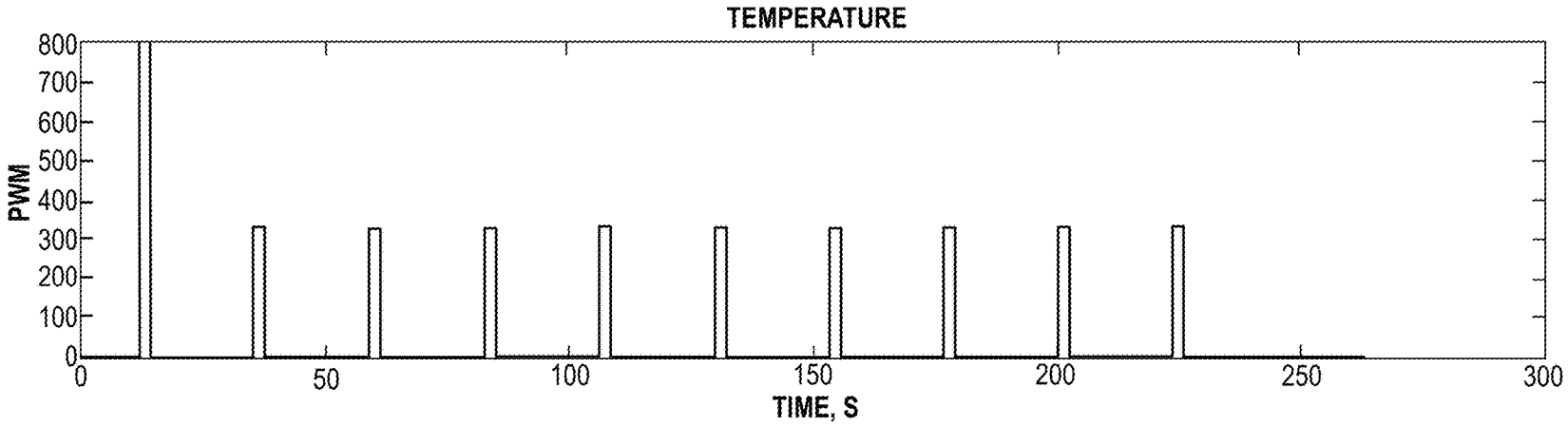
Figure 27:
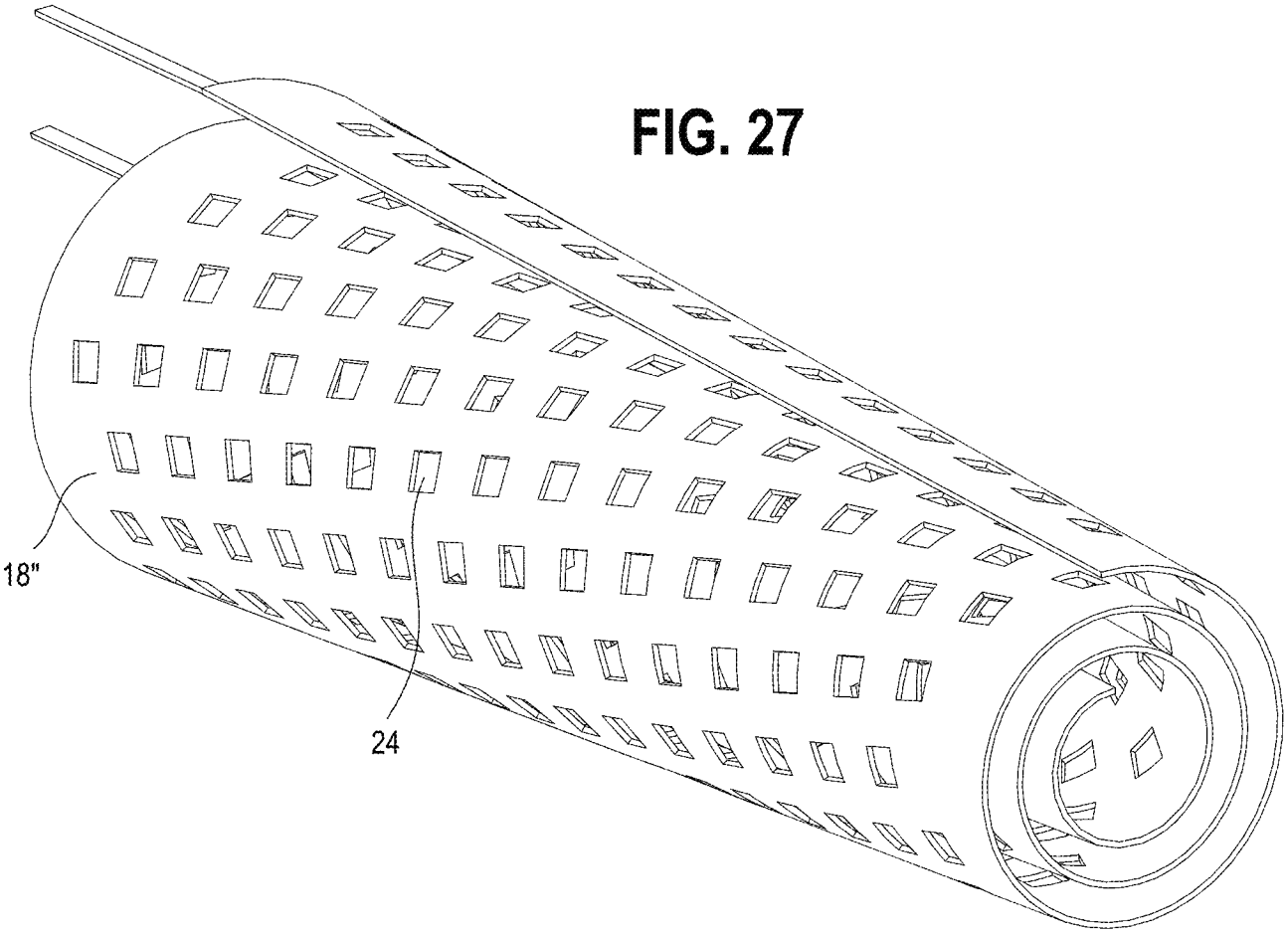
Figure 28:
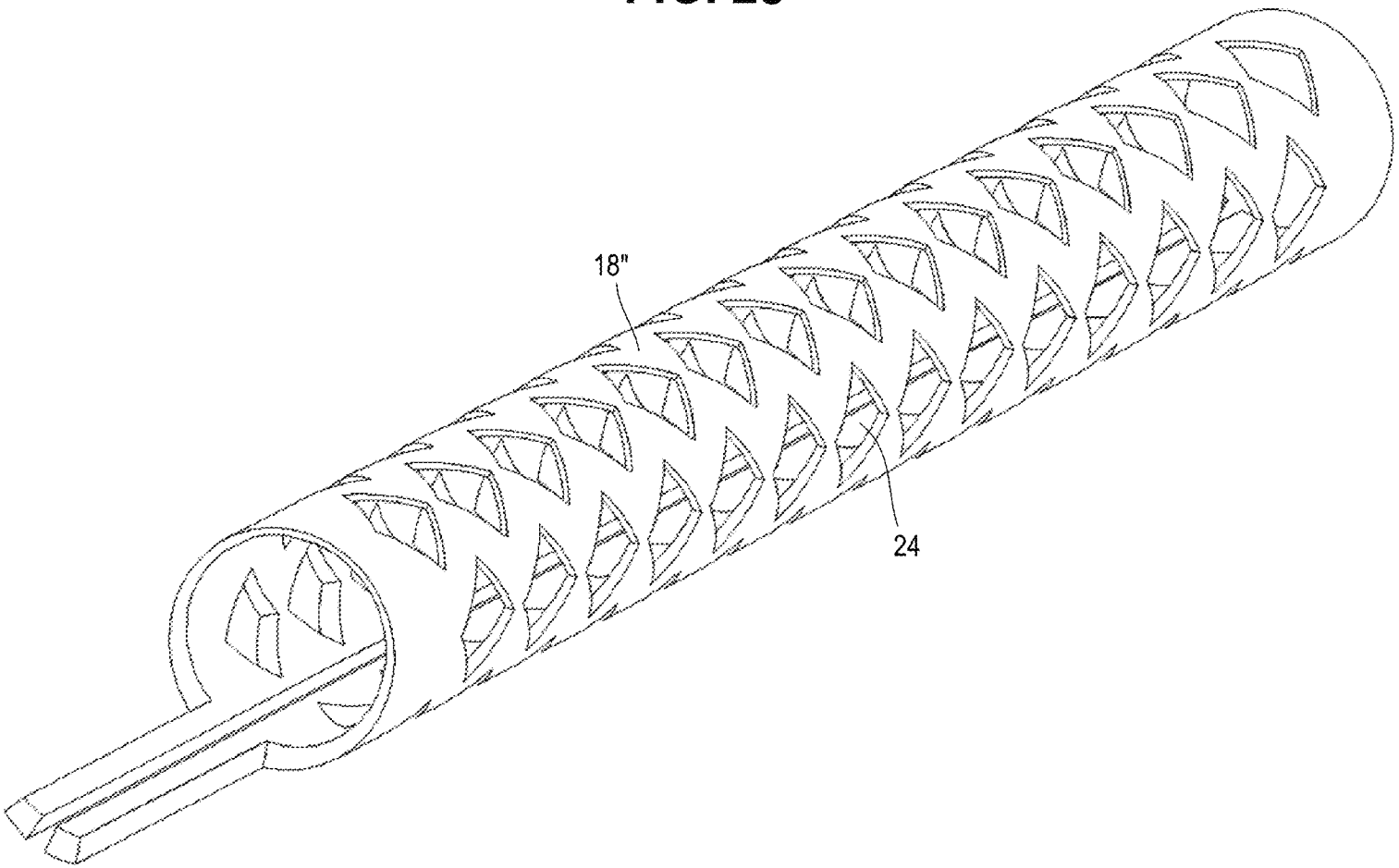
Figure 29:
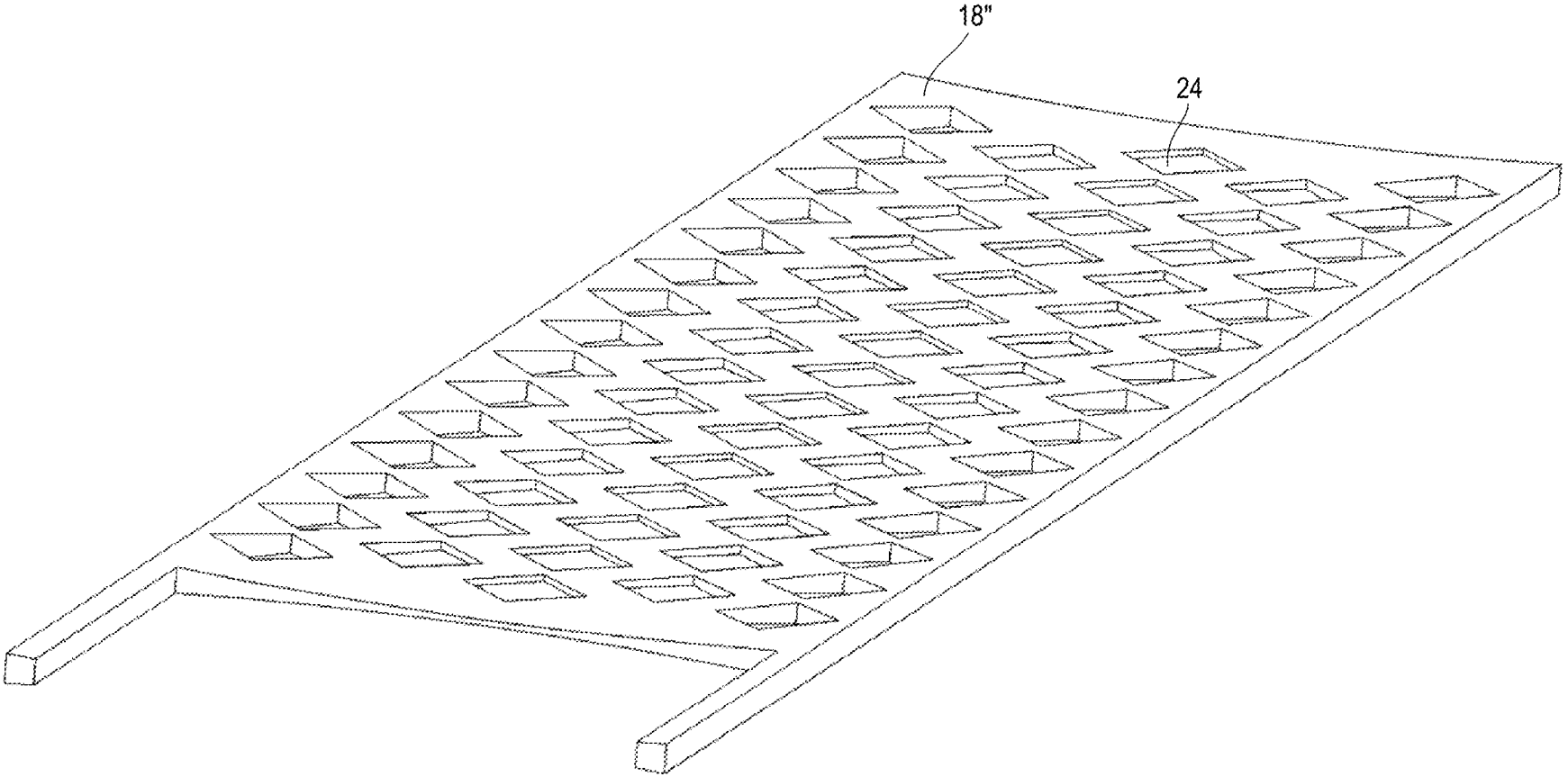
Figure 30:
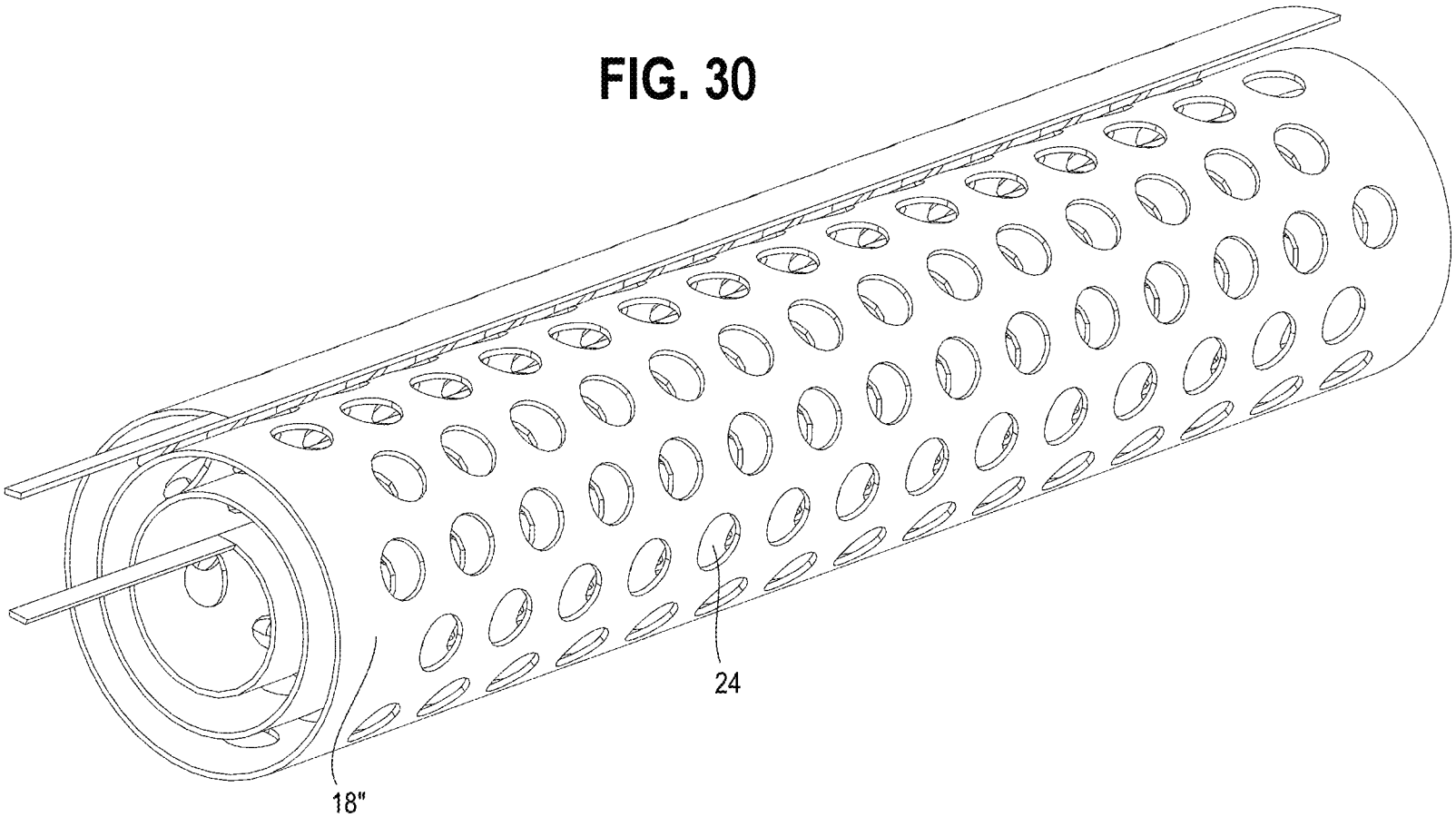
Figure 31:
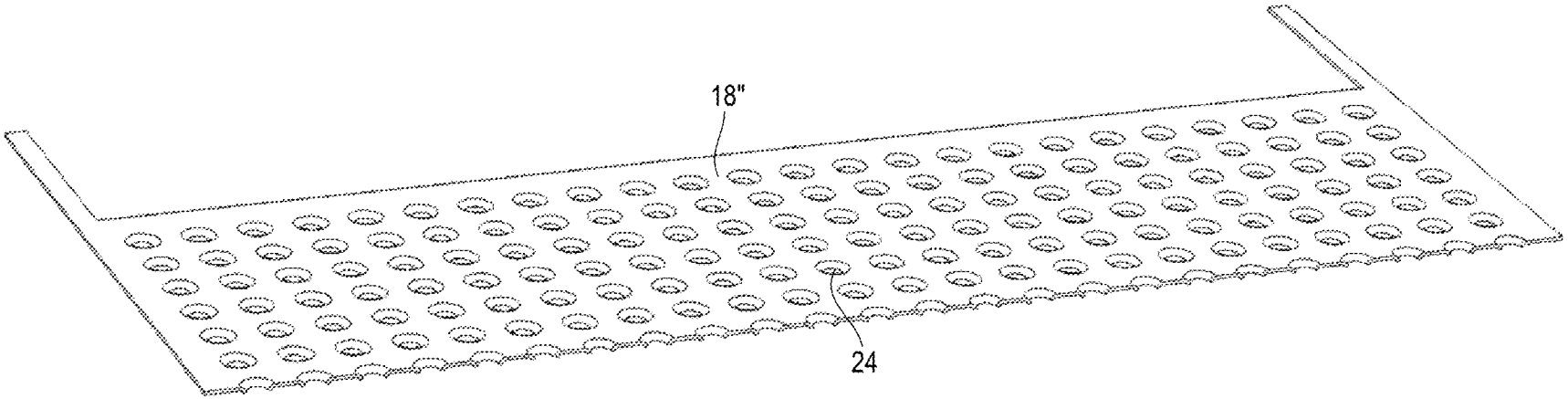
Figure 32:
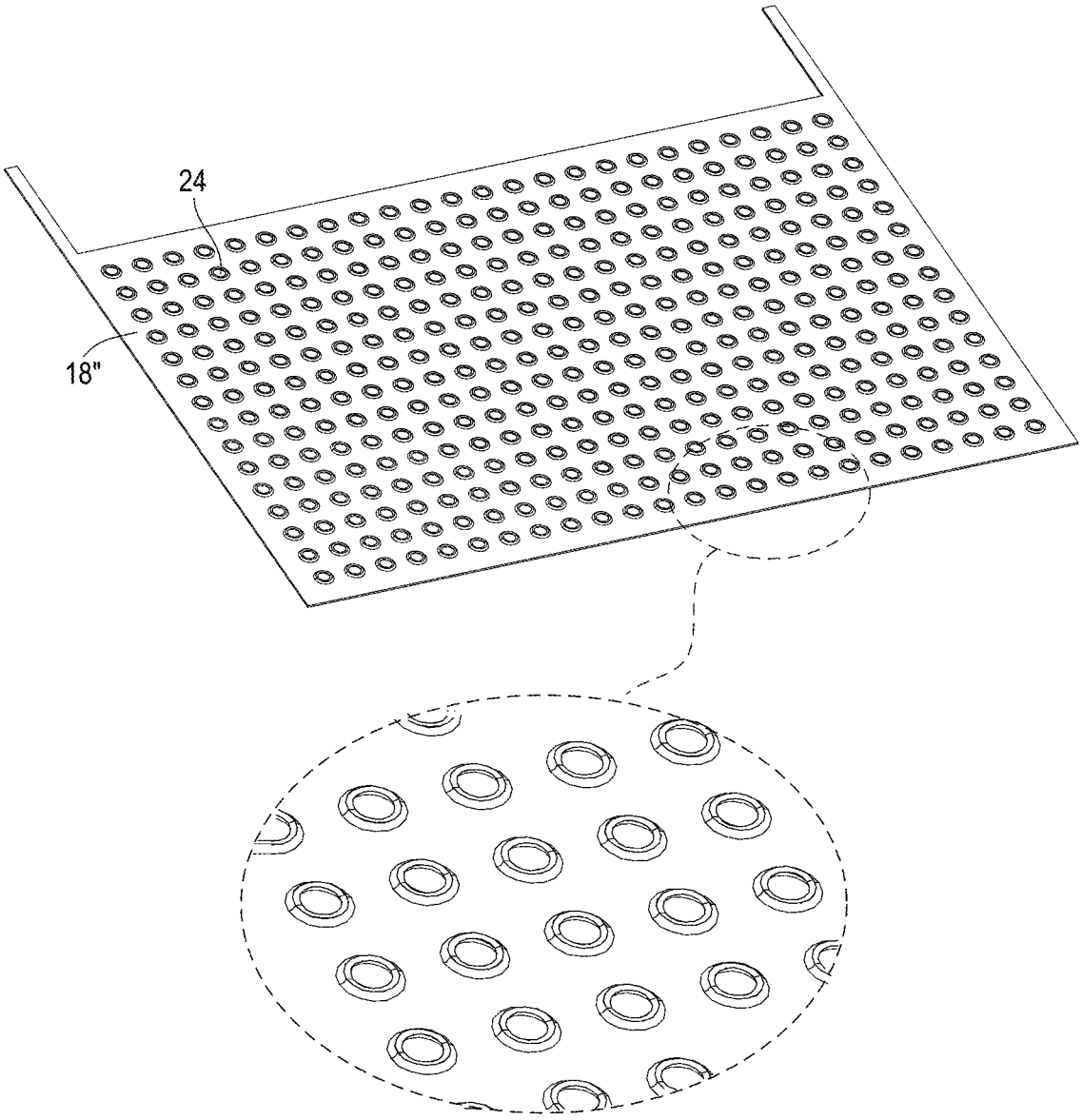
Figure 33:
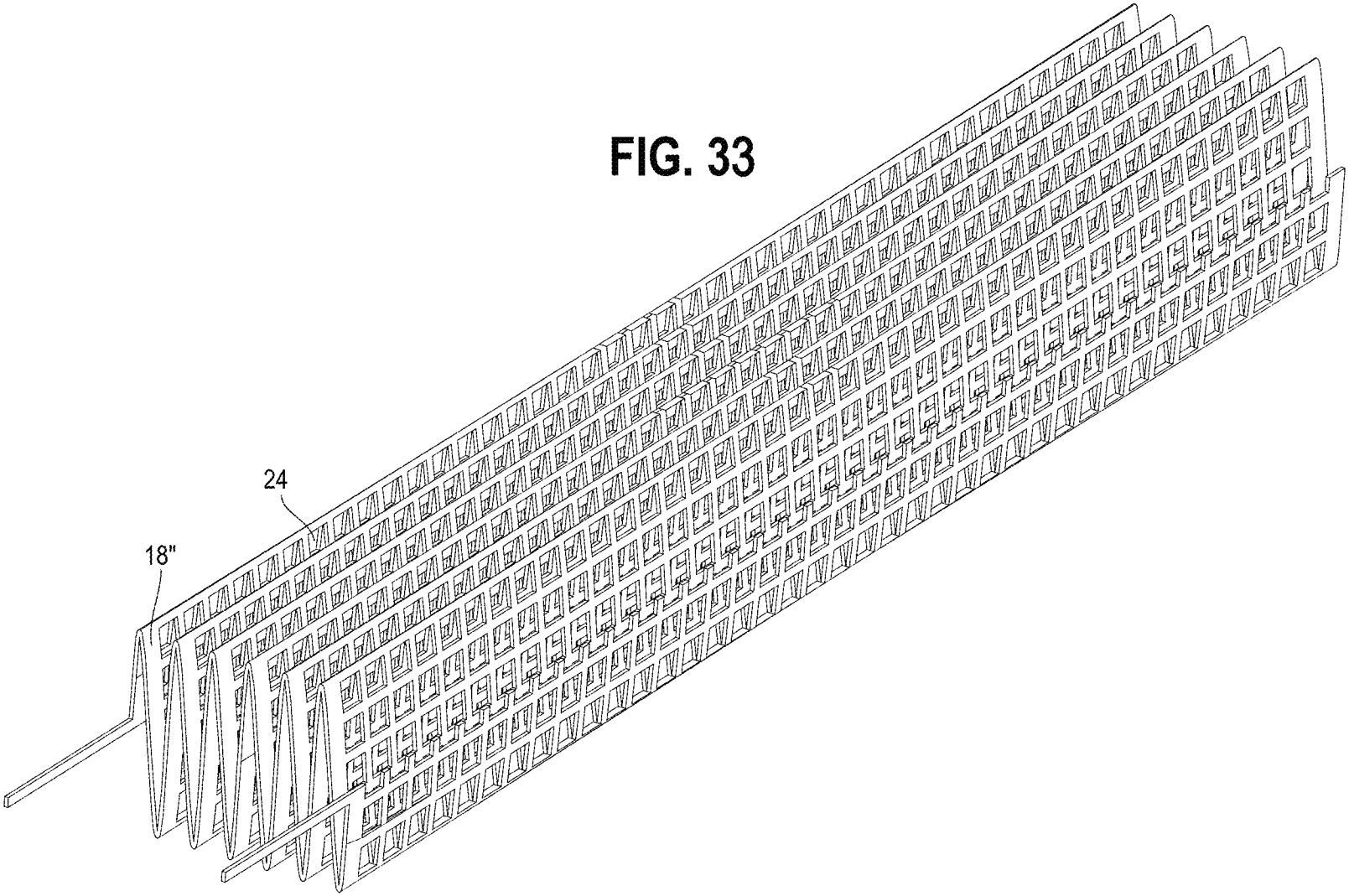
Figure 34:
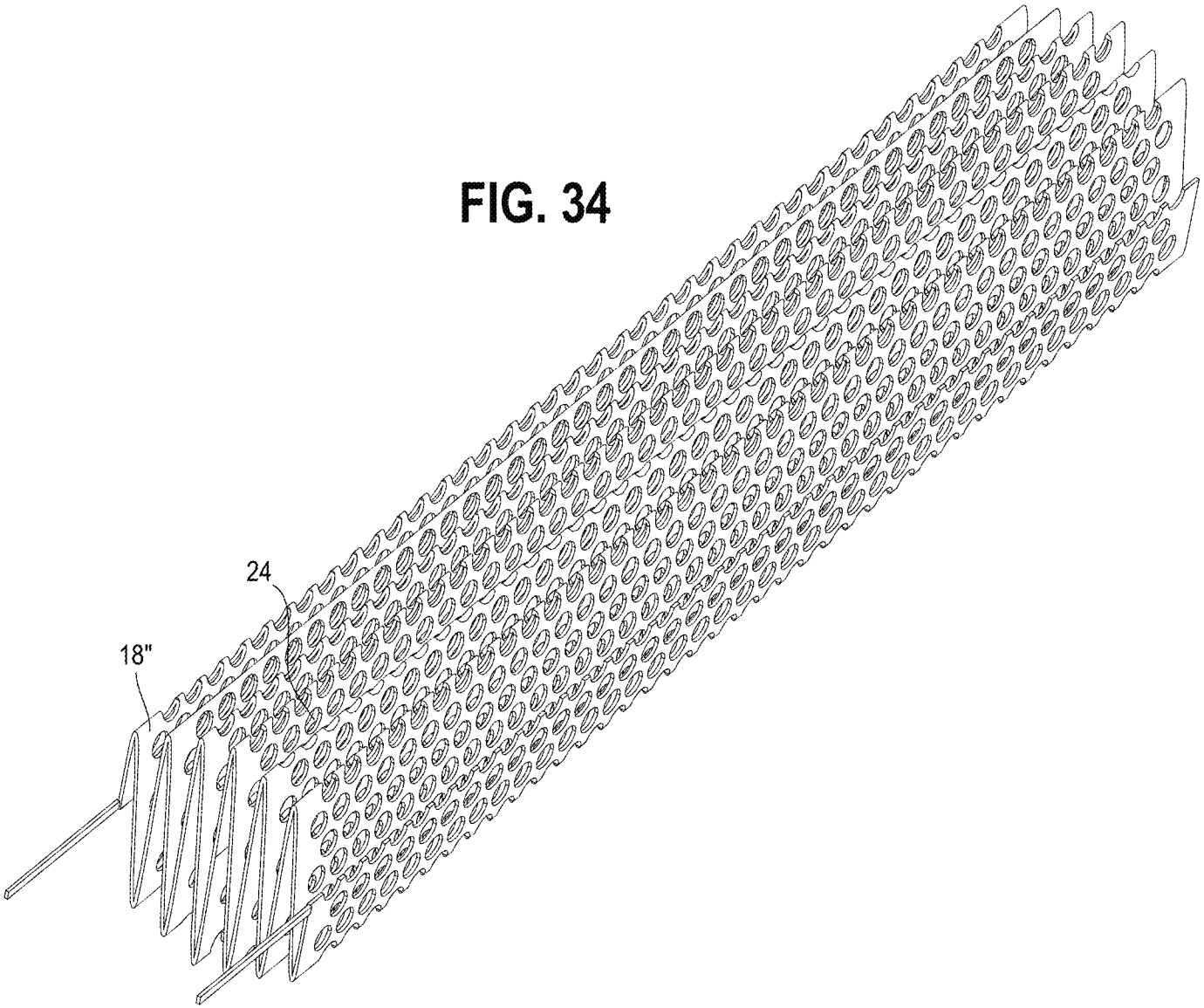

FIG. 18 illustrates a strip heater for the tobacco stick, in unrolled, flattened perspective, consisting of parallel wires connected to contact strips;

FIG. 19 illustrates a strip heater for the tobacco stick, in unrolled, flattened perspective, consisting of metal mesh connected to contact strips;

FIG. 20 illustrates a schematic of the tobacco stick of the embodiment of FIG. 14 wherein each heating elements is electrically connected to two active contact semi-rings of the presently disclosed vaporizer, thereby creating an electrical circuit comprising the heating elements, conductive lines, electronic control and power unit, control button, and battery;

FIG. 21 illustrates another embodiment of a vaporizer with a flip cover where penetrative heaters are provided in the tobacco chamber; when the flip cover is closed the penetrative heaters penetrate the tobacco stick;

FIGS. 22 and 23 show results of testing of prototypes in Example A;

FIG. 24 shows strength of vapor production of prototypes in Example A;

FIG. 25 shows the temperature across time, and shows the (decline) and rise in temperature associated with each puff of prototypes in Example A;

FIG. 26 shows, for the same experiment as FIG. 25, the puff timing;

FIG. 27 shows a conical, rolled lattice design with square shaped voids;

FIG. 28 shows a cylindrical lattice design, with uneven lattice thickness;

FIG. 29 shows the unrolled cylindrical lattice design of FIG. 28, with visible thickness variation on the front edge seen in perspective;

FIG. 30 shows a cylindrical lattice design with circular shaped voids;

FIG. 31 shows the cylindrical lattice design of FIG. 30, unrolled;

FIG. 32 shows an unrolled lattice design with circular voids with a partial enlarged view;

FIG. 33 shows a zig zag lattice design with optional square voids;

FIG. 34 shows a zig zag lattice design with optional circular voids; and

Figure 35:
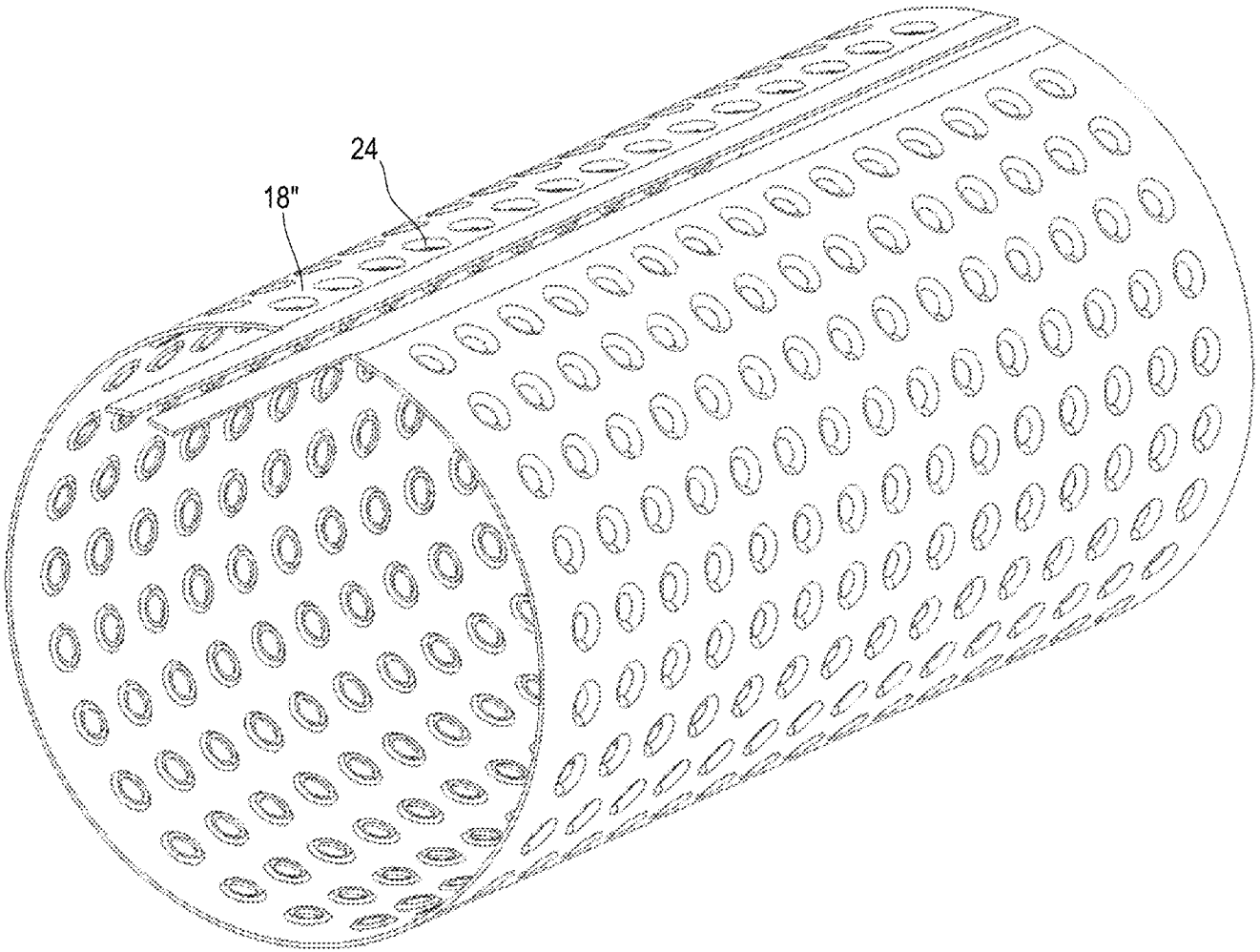

FIG. 35 shows a cylindrical lattice rolled from the lattice of FIG. 32.

DETAILED DESCRIPTION OF THE INVENTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

The present disclosure relates to smoking systems and devices, such as vaporizers for smoking, intended for use in conjunction with special cigarettes (sticks) with which comprise an individual disposable heaters. The presently disclosed devices, sticks, and methods thereof enable smoking without, or substantially without, engagement of the pyrolysis process flow including burning, smoldering, etc. The presently disclosed vaporizer comprises a battery (or other power source), an electronic control and power unit, a control button, a flip cover, and a compound chamber.

By compound chamber, we mean the chamber or space that receives the botanical stick in the device. In most embodiments, the greater part of the stick, lengthwise, sits in the compound chamber during use. Typically, the "filter" portion of the stick extends outside of the compound chamber during use, akin to IQOS® and Glo® products.

As is demonstrated in various figures, including for example FIG. 9 and FIG. 10, part of the inside of the cover forms a portion of the compound chamber itself, so when the cover is open part of the compound chamber opens as part of the cover, leaving the part of the compound chamber that is part of the device exposed. When the cover is closed, part of the inside of the cover forms a portion of the compound chamber. The botanical stick is received in the compound chamber and the cover closed around the botanical stick in the compound chamber during vaping. Thus, the compound chamber may itself open akin to a clamshell. FIG. 9 and FIG. 10 (among others) show part of the compound chamber opened as part of the cover. In most embodiments, half or approximately half of the diameter compound chamber is contained in the open-able cover. By approximately half, we mean the compound chamber bisected lengthwise as shown in FIG. 9 and FIG. 10. In preferred embodiments, at least 40% of the diameter of the compound chamber is contained in the open-able cover, preferably at least 45%, and most preferably 50%.

Typically, the seat of the compound chamber opens with the cover (as shown in FIG. 9 and FIG. 10), or more specifically the portion of the seat associated with the portion of the compound chamber contained in the cover. By seat, we mean the bottom of the compound chamber where the "business" end (i.e., the tobacco end and not the filter end)) of the stick sits or faces embodiments are expressly contemplated where the compound chamber opens above the seat, i.e., the full seat is part of the device and does not open with the cover as in FIG. 9 and FIG. 10.

In preferred embodiments, the entire compound chamber, lengthwise, opens including the seat (as shown in Fig. and FIG. 10). However, in other embodiments, only part of the compound chamber, lengthwise, opens, with the bottom portion of the compound chamber including a fixed portion that does not open. Preferably, at least 65% of the length of the compound chamber opens with the cover (measured lengthwise), more preferably at least 80%, and most preferably at least 90%.

In certain embodiments, the axis of rotation of the hinged flip cover is parallel to an axis that runs through the center of compound chamber (i.e., a line running up through the seat in the center of the compound chamber). Such a configuration is seen, without limitation, in FIG. 8, where the axis of rotation of the hinged flip cover is parallel to axis y.

In certain embodiments, the axis of rotation of the hinged flip cover is perpendicular to an axis that runs through the center of compound chamber (i.e., a line running up through the seat in the center of the compound chamber). Such a configuration is seen, for example, in FIG. 13.

In certain embodiments, where the flip cover uses pistons, the flip cover does not have an axis of rotation. Typically (though without limitation), the flip cover that uses pistons pushes outwards from the device, such that the flip cover has a range of motion that is perpendicular to an axis that runs through the center of compound chamber (i.e., a line running up through the seat in the center of the compound chamber).

In preferred embodiments, the outer (lengthwise) walls of the compound chamber are parallel to a y axis corresponding to a longitudinal axis of the compound chamber (see FIG. 8) and perpendicular to the plane of the x axis. This means that the compound chamber outer walls are neither angled (or curve) inwards or outwards with respect to the plane of the x axis. In other embodiments, at least 80% of the length of the compound chamber outer walls are neither angled (or curve) inwards or outwards with respect to the plane of the x axis, more preferably at least 90%, still more preferably at least 95%, and most preferably at least 98% where length is measured from the seat to the top of the compound chamber.

The cover of the compound chamber opens to allow an easy installation of a special cigarette (also referred to as a botanical stick) into the compound chamber without the cigarette's deformation and without breaching the integrity of its individual disposable resistive heaters and/or the contacts for the heaters. It also allows for an easy and simple removal of the special cigarette from the compound chamber. Opening the flip cover also enables easy access to the compound chamber for the purpose of cleaning or part replacement.

Certain embodiments of the presently disclosed devices are intended for use with special tobacco cigarettes, where the tobacco sticks comprise one or more individual disposable heaters. By disposable, it is generally meant that the heater is disposed of after use together with the stick. In most embodiments, the heater is part of the stick and so it is natural to dispose of the stick and heater together.

In certain embodiments, the presently disclosed device comprises a door, or cover, which may be opened by a user and thereby provide access to the device's compound chamber to enable insertion and removal of the tobacco stick. In most embodiments, a tobacco stick comprising electrical contacts may be reliably installed in the device. By reliably, it is generally meant a 95% or greater success rate, preferably 97% or greater, more preferably 99% or greater. By success rate, we mean that a user, following use instructions, will successfully place the stick in the device with adequate electrical contact(s) between the device and the tobacco stick for successful intended use.

It is an object of certain embodiments of the present invention to provide for a heat-not-burn vaporization device that provides for easy insertion and easy removal of the tobacco stick. It is contemplated that such architecture may be useful even in embodiments that lack a heater in the tobacco stick.

Generally, the presently disclosed heat-not-burn devices, when used with intended tobacco sticks, do not involve (or substantially do not involve) a pyrolysis process flow (such as, burning or smoldering). Therefore, in some embodiments, use of the presently disclosed heat-not-burn devices in combination with the intended tobacco sticks would not result in visible charring. By intended tobacco sticks it is generally meant tobacco sticks designed for use with the presently disclosed device/s.

One advantage of the invention is that the use of a tobacco stick with an individual heater is a novel heat-not-burn architecture that prevents the use of third-party tobacco sticks in a proprietary device. Most embodiments of the present invention will not work with conventional tobacco sticks, lacking a conventional device-based heating system (i.e., the device does not comprise a heater, or does not comprise an adequate heater for use with conventional tobacco sticks).

It is an object of certain embodiments of the present invention to provide for a heat-not-burn vaporization device that allows for easy access to the device's compound chamber, for the purpose of cleaning, part replacement, or any other use.

It is an object of certain embodiments of the present invention to provide for a heat-not-burn vaporization device that substantially minimizes or even eliminates condensate on the compound chamber walls of the vaporization device, for example, when the vaporization device is in use, or after use.

It is an object of certain embodiments of the present invention to eliminate, or substantially eliminate, airflow in the space between the outer dimensions/sides of the stick and the walls of the compound chamber.

It is an object of certain embodiments of the present invention to maximize airflow through the tobacco stick itself, i.e., through the tobacco plug contained in the tobacco stick.

It is an object of certain embodiments of the present invention to reduce variability in pressure drop as measured within one stick session (i.e., puffs from a single stick).

It is an object of certain embodiments of the present invention to reduce the variability in pressure drop as measured and compared between individual stick sessions (e.g., stick to stick comparison). This is achieved by minimizing or eliminating airflow around the edges of the tobacco stick, as the door architecture improves fit tolerances.

It is an object of certain embodiments of the present invention to reduce variability in pressure drop as measured between multiple stick sessions without cleaning in between the sessions.

It is an object of certain embodiments of the present invention to improve the consistency of aerosol output (including the constituent components of the aerosol output), measured both on a puff-to-puff basis in a single stick, and also compared on a stick to stick basis.

It is an object of certain embodiments of the present invention to substantially reduce the amount of residue left by a stick in the compound chamber after use.

It is an object of certain embodiments of the present invention to reduce the presence of harmful, and potentially harmful, constituents in the vapor aerosol, through the use of lower and more consistent vaporization temperatures. By consistency of vaporization temperatures, it is generally meant the amount of variation in temperature of the heating element, and/or in the aerosol temperature, once the device has reached operating temperature (e.g., is in use).

It is an object of certain embodiments of the present invention to enable a device and tobacco stick combination, wherein the tobacco stick is capable of being heated from ambient temperature to operating temperature within ten seconds, preferably within seven seconds, more preferably withing four seconds, most preferably within two seconds.

It is an object of certain embodiments of the present invention to have a heat-not-burn system, wherein the tobacco sticks contain individual heaters, and such heaters are only on (heated) in connection with each puff.

It is an object of certain embodiments of the present invention to reduce the presence of harmful and potentially harmful constituents in the vapor aerosol, through the use of lower and more consistent vaporization temperatures.

It is an object of certain embodiments of the present invention to eliminate the need for a device-based penetrative heater.

It is an object of certain embodiments of the present invention to eliminate the need for a device-based circumferential heater.

It is an object of certain embodiments of the present invention to reduce the variability of harmful and potentially harmful constituents in the vapor aerosol, through the use of lower and more consistent vaporization temperatures, measured intra puff (e.g. within the same stick) and/or stick to stick.

It is an object of certain embodiments of the present invention to improve the nicotine delivery from a tobacco stick, measured as a percentage of the nicotine successfully aerosolized from the tobacco substrate. This is measured by assay of the tobacco substrate before and after use of the tobacco stick to determine the percentage of residual nicotine after use. By use of the tobacco stick, we mean a standard smoking session of seven to twelve puffs (seven, eight, nine, ten, eleven, or twelve puffs).

It is an object of certain embodiments of the present invention to allow a tobacco stick to be placed into the compound chamber without causing its deformation (or without causing substantial deformation), and without breaching the integrity of its individual disposable resistive heaters, as well as facilitating its easy and simple removal from the compound chamber.

It is an object of certain embodiments of the present invention to have device contacts that pierce or perforate a newly inserted tobacco stick without otherwise effecting the tobacco stick's structural formation. Preferably, the tobacco stick remains structurally sound, and capable of holding its tobacco material when removed from the device after use, and during subsequent handling to disposal.

It is an object of certain embodiments of the present invention to minimize or eliminate tobacco residue in the compound chamber after use.

Without limitation, the embodiments of the present invention may use a power supply of at least 4 volts, preferably at least 6 volts, more preferably at least 8 volts. A preferred range is a power supply of 6 to 10 volts.

Without limitation, embodiments of the present invention (using Coresta Method 81) will produce points of vapor per puff in excess of 6000, preferably in excess of 7000, more preferably in excess of 8000, and most preferably in excess of 9000. A preferred range is 7000-1100 points of vapor per puff.

It is an object of certain embodiments of the present invention to allow a tobacco stick to be reliably placed into the compound chamber without deforming, or damaging, the electrical contact surfaces of the tobacco stick.

It is an object of certain embodiments to provide for a compound chamber that is the same, or narrower, in diameter (or width) than the tobacco stick. In some embodiments, the diameter (or width) of the compound chamber and the tobacco stick may be equal, or within small positive differential, or within a small negative differential. By negative differential, we mean that the diameter (or width) of the tobacco stick is wider than the diameter or width of the compound chamber.

The IQOS® 3 duo has a chamber diameter of 7.26 mm, and a chamber length of 27.5 mm. The IQOS® tobacco stick has a diameter of 7.45 mm, and a length of 45.2 mm.

The GLO™ device has a chamber diameter of 5.6 mm, and a chamber length of 77.5 mm. The GLO™ tobacco stick has a diameter of 5.55 mm, and a length of 83 mm. Thus, the diameter differential (i.e. the difference between the chamber diameter and the tobacco stick diameter) is 0.19 mm for IQOS® and 0.05 mm for GLO™. Now, there is a reason for GLO™ to have a smaller diameter differential, namely, GLO™ employs a non-penetrative, circumferential (i.e. heating from the circumference or outside of the stick) heater architecture. Thus, air space between the tobacco stick and compound chamber should be minimized, yet, if there is insufficient diameter differential then it will be too difficult to insert (and remove) the tobacco stick from the compound chamber.

In certain embodiments of the present invention the compound chamber is configured to have a diameter (or width) differential (meaning the differential between the compound chamber diameter and the stick diameter) of −2 mm to 2 mm, preferably −0.2 mm to 0.2 mm, more preferably −0.5 mm to 0.5 mm, most preferably −0.025 mm to 0.025 mm. These distance ranges be also be expressed as negative ranges of −2 mm to 0 mm, −0.5 mm to 0 mm, −0.025 to 0 mm, and positive ranges of 0 mm to 2 mm, 0 mm to 0.5 mm, and 0 mm to 0.025 mm. Smaller differentials are enabled by embodiments of the current invention, as the door architecture does not require the intended length of the stick to be pushed into a fixed compound chamber, which may be particularly problematic when inserting a botanical stick comprising a heater and contacts.

It is an object of certain embodiments of the present invention to reduce, or eliminate, cleaning needs. In certain embodiments of the present invention, the compound chamber requires minimal cleaning, e.g., not more frequently than after every twenty (20) sticks used; preferably not more frequently than after every thirty (30) sticks used; even more preferably not more frequently than after every thirty (30) sticks used; and even more preferably, not more frequently than after every sixty (60) sticks used.

Just as certain embodiments of the present invention ease insertion of the tobacco stick into the compound chamber, such embodiments ease insertion of a cleaning device to clean the compound chamber.

In certain embodiments, the heat-not-burn vaporizer for use with tobacco sticks comprising one or more individual disposable heaters (typically restive heaters comprises at least one of more of the following components and characteristics: a body, a battery, an electronic control and a power unit, a control button, a flip cover, and a compound chamber. The flip cover is installed on the body of the vaporizer and may be removed, or partially removed.

In a preferred embodiment, the flip cover is connected to the body by one or more mechanical bearings which allow rotation, such as (without limitation) hinges.

It is an object of certain embodiments of the present invention to provide a stick comprising a resistive heater in the tobacco substrate (as opposed to around the circumference of the tipping paper or otherwise around the circumference).

In certain embodiments, one or more hinges allow for the possibility of lateral rotation of the flip cover relative to the body to position the flip cover in an open or closed position. The open position of the flip cover may be a fully opened position or otherwise any position that is not the closed position. In the closed position the outside of the flip cover is substantially flush with the outside of the body. In certain embodiments, the flip cover is like a door that hinges open and shut.

When the flip cover is in a closed position, the flip cover and the body define in between them a space open on one end, the space being the compound chamber. The compound chamber is designed for installation of tobacco sticks comprising individual resistive heaters.

The outside of the flip cover may be covered in whole or in part with an easy grip surface.

The insides of the body and the flip cover which face the compound chamber may in some embodiments comprise slots, which may serve as air ducts, installed on or within their surfaces. In some embodiments, the slots may essentially be grooves on the said surfaces. The slots may be of any suitable shape to allow venting of air such as longitudinal, non-longitudinal, or any other shapes. Such air ducts may serve a variety purposes, including inter alia, insulative purposes, to pre-heat air, to offer air intake into the compound chamber at one or more points, or to release heat.

In certain embodiments, the inside of the compound chamber comprises active contact semi-ring(s) to allow electrical interaction with individual resistive heater/s of the stick, when the stick is installed into the compound chamber with the flip cover is in a closed position. The active contact semi-rings are connected by conductive lines to the battery. The active contact semi-rings are also connected to the electronic control and power unit. In some embodiments, the electronic control and power unit is electrically connected to a control button. The control button may be used to activate the battery and thereby turn the device on. In certain other embodiments, there is no control button but the battery is otherwise activated, for example, by a pressure drop. In some embodiments, the device may have a warm-up mode, e.g., of less than 4 seconds. Contacts may be rings or semi-rings, or any other shape.

In certain embodiments, the contacts have a fixed shape. On other embodiments, the contacts are made from a flexible material that changes shape when a botanical stick is inserted and the flip cover is closed.

In certain embodiments, the inside of the flip cover which face the compound chamber may comprise passive contact semi-rings for interaction with individual resistive heaters of a special cigarette, when the special cigarette is installed into the compound chamber with the flip cover in a closed position. In other embodiments, the inside of the flip cover which face the compound chamber does not comprise contact semi-rings or other contacts. In other embodiments, contacts in the inside of the flip cover are live, not passive contacts.

While rings are a preferred contact embodiment, other contact shapes are contemplated.

The contact rings may mate through any method when the door is closed; most commonly by simply touching. Complimentary shapes may be used, e.g. a male-female interlocking or intermingling otherwise complimentary shape.

In certain embodiments, either or both of the device or flip cover comprise long contact strips that run part way, or substantially all, or all of the way of the flip cover length (or width or both) to make successful contact when the flip cover is closed. Such a configuration may be useful for longterm use, to promote successful contact even when hinges wear and tolerance widens.

In some embodiments, the flip cover may be releasably locked in the closed position using any suitable locking means. The locking means comprised in the flip cover therefore engages with a matching locking means (also referred to herein as a retainer) in the body to releasably lock the flip cover in a closed position. As some non-limiting examples, the locking means in the body and flip cover may be magnets enabling magnetic closure, or any type of mechanical closure including a latch or snap-on closures. The possibility to open the flip cover by lateral rotation or releasably lock it in the closed position allows to use the compound chamber as a detachable chamber and thereby increase the convenience of safe installation and removal of the tobacco sticks comprising individual resistive heaters. The locking means, e.g., a latch, holds flip cover tightly to the botanical stick to ensure contacts in the compound chamber meet and make an electrical connection with the contacts of the resistive heater of the botanical stick. In some embodiments, the contacts in the compound chamber can be configured to interlock with the contacts of the resistive heater of the botanical stick. For example, the contacts in the compound chamber and the contacts of the resistive heater of the botanical stick may be configured as interlocking male/female connections.

In some other embodiments, the flip cover is not connected to the body via hinges, or any other attachment means, but rather is entirely removable and can be "snapped" or otherwise stably returned into place. In other words, in some embodiments, the flip cover may be releasably attached to the body. The releasable attachment of the flip cover to the body may be achieved using any suitable means such as, without limitation, magnets, or any type of mechanical attachments including a latch, tongue and groove, or snap-on.

In still other embodiments, one or more pistons are used that can raise or push the flip cover (which in this context can be thought of more as a cover than a flip cover and is also referred to herein as cover) away from the body to allow for easy access to the compound chamber to insert and remove the stick.

In certain embodiments, the flip cover automatically disables power to the contacts when the flip cover is opened.

In other embodiments of the present invention, the novel cover design allows for novel heat blade configurations.

Whereas in the IQOS® system the heat blade pierces the tobacco stick from the bottom, the presently disclosed cover may be employed wherein the cover, by the action of closing, forces the tobacco stick onto one of more heat blades that pierce the tobacco stick from the side. In such embodiments, the heat blade/s may be present in the inside of body facing the compound chamber, the inside of the cover, or both the inside of body facing the compound chamber and the inside of the cover. The heat blade does not have to be a blade, but may be one or more needles, columns or other shapes that penetrate and heat the tobacco stick. Thus, certain embodiments of the device involve a retractable cover (in such various permutations as are described herein), and conductive heating elements that pierce the tobacco stick. In other embodiments, the retractable cover comprises part of a circumferential (non-penetrative) heater, that is competed when the cover is closed.

In certain embodiments of the present invention, the device has one or more retractable penetrative heating elements, that retract when the flip cover is open, and extend and penetrate when the flip cover is closed.

The possibility to open, or remove, the flip cover and thereby gain access to the compound chamber increases the convenience and safety of installation and removal of cigarettes.

The design of allowing opening, or removing, the flip cover allows for a tighter fit between the stick and compound chamber than may be accomplished in conventional heat-not-burn devices, like IQOS®, namely, a tighter fit between compound chamber and the stick than would otherwise be possible. In the traditional designs of vaporizing devices, the stick is inserted from the top of the device down into the compound chamber. This means that the stick must have a narrower diameter than the compound chamber in order to be able to be readily inserted.

With the design of certain embodiments of the present invention, the stick may have the same diameter as the compound chamber, or even a larger diameter than the compound chamber, in which case the compound chamber "squeezes" the stick when the compound chamber is in a closed position. In other embodiments, the stick may have a slightly smaller diameter than the compound chamber, but with a smaller diameter differential than would be otherwise possible without the use of the flip cover.

The compound chamber may comprise gaskets and other flexible materials to allow a tight fit with a stick installed in it. Such flexible materials can reduce, or eliminate, airflow around the outside of the tobacco stick, while reducing deformation of the stick and making it easier to close the flip cover. Gaskets may be made using rubber, silicone, or any other flexible, or otherwise suitable materials. A series of one or more gaskets may be employed. In certain embodiments the gasket is a heat resistant material.

In certain embodiments, the stick has at least one heater on its outsides, or substantially on its outsides. By outside, it is meant that a heater is on the outside (or substantially on the outside) of the tipping paper (or wall of the part of the tube containing the tobacco). By tube it is generally meant the shell of the tobacco stick. Generally, the electrical contacts for the heater will be on the outside as well, where there may be a special contact section. In some embodiments, the heater is disposable; it is used once and discarded with the tobacco stick.

The heater, or heaters, may be adhered, or fastened, to the outside of the tipping paper or other tube material. The heater may be printed on the tipping paper, tube material, or other surface. In other embodiments, the heater may be printed or otherwise adhered to a material that is inside the tipping paper, or the tube. For example, on a cardboard tube (or tube made of any other material/s) that is covered by tipping paper.

In certain embodiments, the stick has a heater on the inside (or substantially on the inside) of the tipping paper or other tube material). By inside, it is meant facing inwards, to the interior of the tube. Electrical contact points may be inside the tipping paper, or otherwise the electrical contact points may be on the outsides of the tipping paper.

As discussed below, in certain embodiments, the heating element, or elements, are inside the tobacco substrate. Alternatively, the heating element may be rolled in with the tobacco substrate, or otherwise in contact with the tobacco substrate.

It is an object of certain embodiments of the present invention to provide for sticks that comprise one or more disposable heaters. Methods of making tobacco sticks with disposable heaters and compositions thereof are disclosed herein.

It is an object of certain embodiments of the present invention to provide a tobacco substrate suitable for use in a heat-not-burn device, such as the presently disclosed heat-not-burn device, wherein the tobacco substrate comprises one or more heating filaments, wherein in some embodiments the tobacco substrate is substantially on, or in direct contact with, the one or more heating filaments.

Preferred methods of manufacture may include, inter alia, solution casting (coating), extrusion, hot melt extrusion, spraying, dipping, or any other suitable deposition method.

In certain embodiments, to enable use, the stick is physically pierced to create an electrical circuit between the electrical contacts of the stick and the device electrical connections when the flip cover is closed, or otherwise fitted into a closed position. The tipping paper may be pierced by the electrical device contacts, said electrical device contacts having a pointed end or otherwise suitable for piercing the tipping paper.

The material for the manufacture of the heating element is preferably a metal foil or filament, which does not contain harmful and toxic elements for human health. Exemplary, non-limitative embodiments include stainless steel foil, titanium, nickel, and blends thereof.

In certain embodiments, the stick has a protrusion, or indentation or other physical marker to facilitate a desired alignment of the stick when fitted into the compound chamber. A defined alignment of the stick may allow for fixed electrical contact points.

In certain embodiments, the stick has a visual indicator, or indicia, to demonstrate the correct alignment of the stick in the compound chamber. For example, a printed mark on the tipping paper.

In other embodiments, the stick and device are designed to mate in such manner that the rotation of the stick inside the compound chamber is not relevant—i.e., the device accepts and effects sufficient electrical contact for any rotational position of the installed stick. One example of such an embodiment is the use of device contact rings. The flip cover architecture of certain embodiments of the present invention enables reliable electrical contacts to be made between the stick and the device.

The convenience and safety of such installation, and removal of the special cigarettes, is also achieved by that the method, in some embodiments, of the cigarette being installed into and removed from the body part of the compound chamber, with an opened flip cover. In certain embodiments, longitudinal (or non-longitudinal) slots, such as longitudinal (or non-longitudinal) air ducts, ensure the necessary air circulation, pre-heating, adequate air intake, insulation, or other purposes while smoking.

In some embodiments, the inside surface of the body part of the compound chamber is equipped with active electrical contacts (which may be semi rings or any other shapes) for interaction with individual resistive heaters of the special cigarette, when the special cigarette is installed into the compound chamber with the flip cover in a closed position. the said compound chamber active electrical contacts, such as the semi-rings electrical contacts, are connected by the conductive lines to the battery through the the electronic control and power unit and optionally the control button. When used with special cigarettes comprising individual resistive heaters the presently disclosed vaporizer provides reliable controlled electrical connectivity of the individual resistive cigarette heaters via electric conductive lines with the device's battery through the electronic control and power unit. In the embodiments that the device comprises a control button, it provides heating when the control button turned on or cooling when the control button is turned off.

In certain embodiments, the device electrical contacts are located solely on body surfaces of the compound chamber (though electrical contacts may extend to semi-rings in the cover when the cover is closed). In other embodiments, the flip cover surfaces of the compound chamber may have active electrical contacts, as well. In certain other embodiments, the flip cover contacts are active, and the device has passive contacts.

In the embodiments wherein the inside surface of the flip cover comprise passive contact semi-rings to allow for electrical interaction with individual resistive heaters of the special cigarette installed into the compound chamber with the flip cover in closed position, it is possible to use special cigarettes comprising individual resistive heaters with the presently disclosed vaporizer and to provide for their close lateral contact with individual resistive heaters as well as electric contact with active contact semi-rings of the fixed part of the compound chamber.

In most embodiments, the passive contact semi-rings of the flip cover part of the chamber by themselves are not connected by conductive lines to the battery through the control button and the electronic control and power unit.

However, when a special cigarette comprising individual resistive heaters is installed in the compound chamber and the flip cover is in a closed position and the individual resistive heaters of the special cigarette form an active electrical circuit with electrical contact/s installed in the body part of the compound chamber, the passive contact semi-rings of the flip cover also become active.

In yet other embodiments, the contacts in the flip cover part of the compound chamber are connected by conducive lines to the battery.

In yet other embodiments, the flip cover does not comprise contacts; all device contacts are in the device body.

In certain embodiments, the passive contact semi-rings are thrust elements that are mechanically pressed against the individual resistive heater of the special cigarette, which is installed into the fixed part of the compound chamber, when the flip cover is closed. Therefore, the said passive contacts may become active upon use of the special cigarette. This is explained by the fact that for the time of smoking the passive contacts are reliably controlled by the electrical connection through individual resistive cigarette heaters which are in electrical circuit with the active contacts (such as active contact semi-rings) of the body of the compound chamber connected in turn to the conductive lines and then the battery through the electronic control and power unit.

In embodiments where the device's electrical contacts are solely in the body part of the compound chamber, the flip cover serves to hold the tobacco stick (and the tobacco stick's contacts) in sufficient physical/electrical contact with the body part (and its active electrical contacts) of the compound chamber.

Contacts, such as electrical contacts, for the device may take a number of forms, including without limitation semi-rings. Semi rings are particularly well suited to cylindrical tobacco sticks. Non-cylindrical tobacco sticks would typically be used with correspondingly shaped device contact rings in certain other embodiments. In other embodiments, other configurations may be used. For example, the compound chamber may contain individual contacts that correspond to contacts on the botanical stick.

Generally, the contacts in the compound chamber will correspond, height-wise, to contacts on (or in) the botanical stick such that they mate when the botanical stick is in the closed compound chamber.

Another embodiment for device contacts involves the use of activated pins. Such pins may employ springs, like for example a pogo pin. The pins may be used simply to achieve connection with outer contacts on the tobacco stick, or in certain embodiments pins (device contacts) may penetrate the tipping paper of the tobacco stick to reach internal contacts on the tobacco stick. In other embodiments, the pins are blunt to avoid piercing or tearing the tipping paper.

Thus, the presently disclosed embodiments of the vaporizer allow easy installation of a special cigarette comprising individual resistive heaters into a compound chamber without causing the cigarette's further deformation (or substantially without deformation). Insofar as the heating element used in disposable to botanical stick will tend to us thin metal material, deformation of the stick (for this and other reasons) is potentially problematic.

Generally, the compound chamber in its turn is defined by the space defined in between the flip cover when in a closed position and the vaporizer body. The compound chamber when formed by the closure, or installment, of the flip cover does not breach the integrity of the cigarette and its individual disposable resistive heaters.

An easy and simple removal of the special cigarette from the compound chamber is achieved when the flip cover is being opened by means of its lateral or other rotation.

Moreover, some embodiments of the vaporizer for smoking special cigarettes comprising an individual heater has a technical feature of a flip cover retainer (retainer is also referred to herein as locking means). The flip cover retainer is optionally made in the form of magnets, preferably neodymium, or in the form of a mechanical latch.

It is noted that the flip cover design described herein may be applied to devices for use with sticks that lack individual heaters, offering the advantages described herein for conventional tobacco sticks that do not contain individual heaters.

A neodymium magnet is a powerful permanent magnet consisting of an alloy of a rare-earth element neodymium, boron and iron, possessing a powerful magnetic attraction and high resistance to demagnetization. The application of neodymium magnets (or other magnets) as flip cover retainers ensures the safe position of the vaporizer's flip cover when it is closed while smoking a cigarette with an individual resistive heater. Other magnetic materials may be employed.

Any compact mechanical locking means can be used as a mechanical latch of the retainer. Mechanical locking may be employed alone or in conjunction with magnetic closure or other known closure method.

Other aspects of the present invention relating to a heating element or elements for a tobacco stick that is dip coated, spray coated, or otherwise covered with tobacco substrate. This is different from conventional heat sticks that employ reconstituted tobacco leaf and include that "leaf" in the tobacco stick either akin to a conventional cigarette, in a plug, or otherwise.

In such embodiments, the heating element is coated or covered with tobacco substrate. Typically, a solvent is used to create a tobacco mixture, which is then applied to the heating element. The heating element (or multiple elements) are covered with tobacco substrate. The heater with tobacco substrate is then made part of a device that includes power for the heating element, and other elements of a vaporization device.

The solvent used to make the tobacco mixture may be polar or non-polar.

The tobacco mixture may comprise a polymer from 0.01% to 50% of the dried composition.

This allows for a disposable heater that is in direct contact with the tobacco substrate, without the need to pierce the substrate with a heater, or surround the substrate with heater (like BAT's glo device). The result may include improved energy efficiency, and a smaller device profile. Additionally, the tobacco substrate may be more effectively brought into desired temperature range for aerosolization.

Operating temperature ranges may range from 150 to 400 C, preferably 180 to 240 C, more preferably 190 to 220 C. These ranges are non limitative and the operating temperatures may be below 150 C or above 400 C.

In certain embodiments, the heating element is part of a larger lattice structure. The lattice structure may include parts that function as heating elements, and other parts that serve as a base or form where substrate can be adhered. The lattice may be designed to optimize distance between non-heating portions and heating portions. The material for the non-heating portion may be selected for its heat transfer properties.

In certain embodiments, the combination of non-heating and heating portions allows for a larger structure on which to apply the tobacco composition. The lattice may comprise voids or holes, gaps, cups, depressions or other geometries calculated to result in uneven substrate application that are narrow or small enough such that the tobacco composition, when applied to the lattice, has sufficient surface tension such that the coated tobacco composition substantially lacks voids (or holes or gaps) when applied to the lattice, and may substantially lack voids (or holes or gaps) after the tobacco composition is dried. In certain embodiments, the rheology of the tobacco composition to be applied is calibrated so as the substantially avoid voids (or holes or gaps), i.e., to have adequate surface tension on the lattice material. Likewise, the surface energy of the lattice material may be selected in connection with this calibration.

Depressions or cups may be particularly useful to result in uneven thickness of the dried tobacco substrate. Uneven dried tobacco thickness may be employed to result in more even temperatures and more even vapor production, puff to puff. This may have the effect of increasing surface area contact between the susbtrate and the heater or lattice.

Certain embodiments of the lattice are substantially flat (i.e. a planar or substantially planar surface). In other embodiments, the lattice is three dimensional. Optionally, the lattice has a conical or substantially conical outer shape. Optionally, the lattice has a cylindrical or substantially cylindrical shape. Optionally the lattice is not substantially flat, conical or cylindrical.

The lattice optionally comprises one or more layers or levels, optionally considered outwards from a lengthwise access of symmetry.

The lattice may be comprised of one of more materials.

A variety of non-limitative lattice or heater designs are shown in FIGS. 27-35.

After the substrate is applied to the heater or lattice, the substrate is typically dried to substantially reduce or eliminate solvent. Typically, the solvent employed is water due to the intended respiratory use of the product. However, in certain non-preferred embodiments, non-water solvents may be employed.

The substrate material may be sprayed, dipped, formed, shaped or otherwise coated onto the heater or lattice. In certain embodiments, the substrate material is extruded together with the heater or heaters, to form a shape that comprises the substrate and the heater. The extrusion may be non-aqueous, substantially non-aqueous, employ a non-water solvent, or operate by hot melt extrusion. Aqueous extruded compositions are the preferred embodiment.

In certain embodiments, the tobacco composition is extruded together with heating filaments (or other heater shapes) from an extruder.

In certain embodiments, the tobacco composition is cast onto heating filaments (or heating element or lattice) using a standard coating apparatus (for example and without limitation, reverse roll coater, metering rod or meyer bar, slot die, knife over roll, doctor blade, etc). Optionally, the filaments (or other heating elements or lattice) are placed on a substrate. In other embodiments, the tobacco composition is cast onto the filaments (or other heating elements or lattice) over a band caster. The tobacco composition after casting is dried. Optionally, a second layer of tobacco composition is then cast onto the dried layer that contains the heating filaments (or other heating elements or lattice). Alternatively, a second layer is made separately and is laminated or otherwise attached to the coated filaments (or coating heating elements or lattice). Laminated layers can also be attached to compositions that have been made through non-cast methods, i.e. dip coated, spray coated, formed, shaped, deposited etc.

In certain embodiments, iterations are employed to apply the tobacco composition, and the tobacco composition may vary from iteration to iteration. For example, the lattice may be dip coated with one tobacco compositional, optionally dried, and then dip coated a second time, optionally with a different tobacco composition. It is expressly contemplated that this iterative application process may be employed with the other application methods, including inter alia the other application methods described herein.

One significant advantage of certain embodiments of the present invention, is that drying may be pursued more aggressively, meaning, to a drier final moisture level (i.e. moisture level after drying). This is because water is typically used as a plasticizer in reconstituted tobacco, including such reconstituted tobacco as is used as a tobacco substrate in heat not burn products. In the conventional manufacturing method, the substrate is cast and then rolled onto itself. Afterwards, it is unwound and converted into the desired shape, e.g. a tobacco plug used in commercially sold Heets®.

However, where the substrate is dried on the heater or lattice (including the individual heater or lattice), and not subjected to physical processing or manipulation after drying and before use, a broader tolerance applies to the substrate, i.e. the substrate does not require the same physical or mechanical properties as are required with existing heat not burn products. Stated simply, the fact that cast tobacco recon is rolled up after drying requires it to have a great deal of pliability, typically associated with high water content as a plasticizer. Such pliability requirements do not apply in certain embodiments of the present invention.

Stated another way, those familiar with casting will understand that the ability to roll up the continuous substrate after casting requires a great deal of plasticity, and that in turn is going to be achieved, inter alia, with a high moisture (water content). However, such a high moisture content is undesirable in a heat-not-burn product, due to the high energy requirement to aerosolize water, without material benefit for the user (though in certain niche cases, higher moisture levels may be desired, for example and without limitation, in conjunction with certain flavors). It is for this reason that the use of water-based extracts has been disfavored in the vaping industry and by vaping consumers.

By the same token, drying the tobacco substrate directly on the heater or lattice allows for the use of weaker, thinner and/or cheaper heater or lattice materials. When the substrate is cast with or on filaments, then dried and rolled, the filaments too must be strong enough not to break or crack, which will lead to product failure or underperformance.

Plasticizers may be employed in the tobacco composition, in an amount from 0.01% to 15% of the composition by weight. However, in propylene glycol, which may serve as both a plasticizer and a vapor agent, the amount used may exceed 15% of the composition by weight.

The lattice (or heating element design and structure) may be designed such that, when the tobacco composition is applied, the tobacco composition has a variable wet and/or dried thickness. This contrasts with conventional reconstituted (aka recon) tobacco, which is typically coated and dried to a uniform thickness (as a function of uniform application of the tobacco composition by the coater apparatus on a substrate). The advantage of variable thickness is to affect a more consistent puff to puff nicotine and vapor delivery over the use of the botanical stick, as the thicker portions of the tobacco composition will be slower to heat and release aerosolizable components. In contrast, thinner portions will heat faster and more quickly release aerosolizable components.

Variable thickness on the lattice may involve interplay among lattice design, the tobacco composition application method, and the rheological properties of the tobacco composition.

For example, the lattice may have depressions or other shapes where the tobacco composition may pool and aggregate. The lattice may have a structure without depressions that is conducive to varied collection of the tobacco composition.

The method of applying the tobacco composition may be calculated to leave an uneven coating. For example and without limitation, spraying a lattice (or heater or filament) from a particular angle or angles may lead to uneven application of the tobacco composition, both before nad after drying.

In certain embodiments, the dried thickness of the tobacco substrate coating varies in thickness over its surface area by at least 15%, preferably at least 25%, most preferably at least 35%.

An additional method to effect consistent vapor delivery is in the design of the lattice as respects portions of the lattice that heat more quickly than other portions. For example, where the lattice comprises portions that are a heating element, and portions that are not. In other examples, the heating element itself has variable heating properties.

The lattice or heating element or filament may be pretreated, in whole, substantially are in part, with one or more pretreatment substances prior to applying the tobacco composition. The pretreatment may be one or more substances. It may comprise a polar or non polar solvent. The pretreatment substance is typically a liquid. The pretreatment substance may by hydrophobic or hydrophilic. The pretreatment may be used to encourage adhesion of the tobacco composition. The pretreatment may be used to encourage uneven adhesion of the tobacco composition (i.e. variations in thickness).

By applying the substrate on the heater or lattice, embodiments of the present invention may have a tobacco substrate with a moisture content (after drying) of less than 10%, preferably less than 7%, sill more preferably less than 5% and even more preferably less than 3%.

Consideration of drying is important. Typically, tobacco substrates when cast are dried using hot air currents. This is standard practice in the coating industry. However, Applicants suggest two novel methods of drying as applied to tobacco substrates. The first is lyophilization, or freeze drying. Lyophalization is a method of drying calculated to leave voids, which are useful in terms of providing effluent channels for aerosol when the substrate is heated.

The second is the use of ultrasonic frequency during drying. Typically, a set of one or more acoustic whistles are employed that disrupt the surface of the material and increase heat transfer thereby. Typically, the acoustic whistles are used in connection with one or more conventional drying techniques, such as hot air currents, infared, etc. The use of ultrasonic is known as a method in food applications to increase drying efficiency but the practice enjoys little use due to surface mottle in dried product associated with the ultrasonic disruption. However, for this application, surface mottle may be tolerated, and even desirable insofar as it increases surface area of the dried composition and may increase the aersolization of aerosolizable components from the tobacco composition. Moreover, any surface mottle will typically be unseen as the tobacco substrate is shrouded or obscured by the tipping paper.

In certain embodiments, a special shape of heater is achieved by folding the metal foil heater together with tobacco substrate, to increase the contact area between heater and tobacco substrate. In certain embodiments, the metal foil and tobacco substrate are rolled alternating layers, of tobacco—heater—tobacco—heater, and so on. Alternating layers may be in a roll, an accordion shape, or other geometry.

It is understood that embodiments of the present invention may be used with tobacco, smoking herbs, other plant herbs, marijuana and its concentrates and/or derivatives, nicotine, nicotine salts, or any chemically synthesized material intended for vaporization, or any combination thereof. Thus, by "tobacco stick" in this specification, applicant is referring to sticks not only containing tobacco (e.g., reconstituted tobacco and/or tobacco leaf and/or tobacco stem) but alternatively, or additionally containing herbs, other plant herbs, marijuana and its concentrates and/or derivatives or cannabinoids, other botanicals, nicotine, nicotine salts, or any chemically synthesized material intended for vaporization, or any combination thereof. The tobacco stick may be cylindrical, oval, rectangular, or other shape. The tobacco stick may comprise a filter. The tobacco or other material may be wrapped in paper or non-paper material. While the term "tobacco stick" is used herein for convenience, it should be noted that the term "tobacco stick" is being used as the equivalent to "botanical stick."

Referring now to FIGS. 1-12, the vaporizer for smoking tobacco stick comprises at least one individual heater comprising a body or housing (1, FIG. 3), a battery (2) provided in a battery compartment (2') configured to hold the battery (2), an electronic control and power unit (3), a control button (4), a flip cover (5) installed on the body (1) with the help of hinges (6) and with the possibility of its lateral rotation and fixation in the closed position by the latch (or any locking means) (7), a compound chamber (8) for the removable installation of special cigarettes (tobacco sticks) generally designated with the reference numeral (9) with individual resistive heaters (10).

The compound chamber (8) for the installation of tobacco sticks (9) comprising individual resistive heaters (10) is defined by the space created in between the body portion (11) and flip cover portion (12), when the flip cover (5) is in a closed position, with longitudinal slots acting as air ducts (13), installed respectively on the body portion (11) and on the flip cover portion (12). The compound chamber may include a rubber gasket.

The body portion (11) of the compound chamber (8) in the housing (1) of the vaporizer, is equipped with active contact semi-rings (14) for interaction with individual resistive heaters (10) of the tobacco stick (9) installed into the compound chamber (8) with the closed flip cover (5).

Active contact semi-rings (14) are connected by conductive lines (15) to the battery (2) through the control button (4) and the electronic control and power unit (3) (see FIGS. 11 and 12).

The portion of the flip over (12) forming the compound chamber (8) in the flip cover (5) when closed, is equipped with passive contact semi-rings (16) for interaction with individual resistive heaters (10) of the tobacco stick (9) installed into the compound chamber (8) with the closed flip cover (5). The passive contact semi-rings (16) are provided to securely support the individual resistive heaters (10) of the tobacco stick (9) installed into the compound chamber (8) with the closed flip cover (5). The passive contact semi-rings (16) are optionally not connected to the battery. In other embodiments, the passive contact semi-rings become active when the door is closed, or are separately connected to the battery.

The vaporizer can be used to vape tobacco sticks (9) (embodiment 1, see FIG. 1) with an individual heater (10) made, for example, of foil and having two contact rings (17), and with one heating surface (18) in the form of several longitudinal stripes located between the above-mentioned two contact rings (17), and with a filter (9') for filtering the substance vapor.

In this embodiment of the vaporizer (embodiment 1), the body portion (11) forming the compound chamber (8) in the body (1) of the vaporizer, is equipped with two active contact semi-rings (14) for interaction with the two contact rings (17) of the individual resistive heater (10) of the tobacco stick (9) (embodiment 1) removably installed into the compound chamber (8) with the closed flip cover (5), and the portion (12) of the flip cover (5), forming the compound chamber (8) when the flip cover (5) is closed is in its turn equipped with two passive (or active) contact semi-rings (16) (see FIGS. 3, 5, 6, 8, 10 anal).

The vaporizer can be used to vape tobacco sticks (9) (embodiment 2, see FIG. 2) with an individual heater (10) made, for example, of foil, and having three contact rings (17), and with two heating surfaces (18) in the form of several longitudinal stripes, located between the above-mentioned three contact rings (17).

In this embodiment of the vaporizer (embodiment 2), the body part (11) of the compound chamber (8) in the body (1) of the vaporizer, is equipped with three active contact semi-rings (14) for interaction with the three contact rings (17) of the individual resistive heater (10) of the tobacco stick (9) (embodiment 2) installed into the compound chamber (8) with the closed flip cover (5), and the part (12) of the compound chamber (8) in the flip cover (5) of the vaporizer is in its turn equipped with three passive contact semi-rings (16) (see FIGS. 9 and 12).

The battery (2) is connected with the contact rings (17) and the heating surface (18) by conductive lines (15) through the electronic control and power unit (3), through active contact semi-rings (14) of the fixed part (11) of the compound chamber (8) in the body (1) of the vaporizer (see FIGS. 11 and 12), and through passive or active contact semi-rings (16) of the movable part (12) of the compound chamber (8) in the flip cover (5) of the vaporizer. In its turn, the heating surface (18) of an individual resistive heater (10) heats up the tobacco tab—the tobacco substrate of the tobacco stick (9), and is made in the form of several longitudinal stripes.

In the vaporizer for smoking cigarettes with an individual heater, the retainer (7) of the flip cover (5) is made in the form of magnets, preferably neodymium, or in the form of a mechanical latch.

Any compact mechanical locking mean can be used as a mechanical latch of the retainer.

The presently disclosed vaporizer for smoking cigarettes with an individual heater is applied as described below.

To conduct a vaping session with a vaporizer (for example, according to embodiment 1), the user installs a tobacco stick (9) with an individual heater (10) (embodiment 1) made, for example, from foil, and having two contact rings (17) and one heating surface (18) in the form of several longitudinal stripes located between the above-mentioned two contact rings (17) in the compound chamber (8) of the vaporizer's body (1) (see FIG. 1).

For this purpose, the user unfastens the latch (7), made, for example, in the form of neodymium magnets, and opens the flip cover (5), installed on the body (1) with the help of hinges (6) (see FIGS. 3, 4 and 5).

Next, the user installs the tobacco stick (9) into the body part (11) of the compound chamber (8) in the body (1) of the vaporizer (see FIGS. 5 and 6).

Then, the user closes the flip cover (5), which is fixed in the closed position by the above-mentioned latch (7) (see FIG. 7).

At the same time, the active contact semi-rings (14) of the body part (11) of the compound chamber (8) in the body (1) of the vaporizer abut to the contact rings (17) of the heater (10) installed on the sleeve of the tobacco stick (9).

The compression force of the tobacco stick (9) by the active contact semi-rings (14) of the body part (11) of the compound chamber (8) in the vaporizer's body (1) and by the passive contact semi-rings (16) of the part (12) of the compound chamber (8) in the vaporizer's flip cover (5), when it is closed, is sufficient for reliable fixation of the tobacco stick (9) in the compound chamber (8), and provides the necessary electrical contact between the mentioned active and passive contact semi-rings (14, 16) with the contact rings (17) of the individual resistive heater (10) of the tobacco stick (9).

At the same time, the tobacco stick (9) itself does not undergo any mechanical deformations.

Then, the user activates the heating process of the individual resistive heater (10) by pressing the control button (4).

At the same time, the voltage from the battery (2) goes along the conductive lines (15) through the electronic control and power unit (3), then through the active contact semi-rings (14) of the body part (11) of the compound chamber (8) in the vaporizer's body (1) and through the passive contact semi-rings (16) of the part (12) of the compound chamber (8) in the vaporizer's flip cover (5) to the contact rings (17) and to the heating surface (18) of the individual resistive heater (10) (see FIG. 11).

The heating surface (18), made in the form of several longitudinal stripes, starts to heat up the tobacco tab—the tobacco substrate of the tobacco stick (9).

The active substance inhaled by the user begins to evaporate from the heated substrate of the tobacco stick (9).

The heat from the individual resistive heater (10) also heats the air between the tobacco stick (9) and the walls of the compound chamber (8).

The user makes a puff and the heated air enters the tobacco stick (9), and the next portion of fresh air flows along the longitudinal air ducts (13) of the body (11) and the flip cover (12) parts again into the compound chamber (8) and passes by the heater (10), heating the latter.

Since the part of the sleeve of the tobacco stick (9), which is exposed to heating, contacts the elements of the vaporizer only in two places where the contact rings (17) of the individual resistive heater (10) of the tobacco stick (9) are located, it allows to reduce the heating of the walls and to reduce the thickness of the thermal insulation layer of the compound chamber (8). However, in some embodiments, it may be desirable to provide insulation around the compound chamber, e.g., in the flip cover (12).

At the same time, the remaining part of the sleeve of the tobacco stick (9), where the heating surface (18) of the individual resistive heater (10) is located, does not contact with anything, which ensures low inertia of heating time of the active substance contained in the tobacco substrate of the tobacco stick (9).

This makes it possible to use the smoking mode when the voltage is supplied to the heater only when the user makes a puff.

The heating temperature of the tobacco stick (9) is monitored and adjusted with the help of a temperature sensor installed inside of the compound chamber (8).

Thus, the heater itself (10) can be used as a temperature sensor.

The heating temperature of the tobacco substrate of the tobacco stick (9) should not cause smoldering or burning of the paper of the sleeve and the tobacco substrate, but should be sufficient to evaporate the active substance from the substrate.

Gradually all the active substance contained in the tobacco substrate of the tobacco stick (9) can be vaporized.

The vaporizer (embodiment 2) can be used to vape cigarettes (9) (embodiment 2) with an individual heater (10) made, for example, of foil and having three contact rings (17), and with two heating surfaces (18) in the form of several longitudinal stripes located between the above-mentioned three contact rings (17) (see FIG. 2).

In such modification of a vaporizer, the body part (11) of the compound chamber (8) in the vaporizer's body (1), is equipped with three active contact semi-rings (14) for interaction with the three contact rings (17) of the individual resistive heater (10) of the tobacco stick (9) which is installed into the compound chamber (8) with the closed flip cover (5); and the part (12) of the compound chamber (8) in the vaporizer's flip cover (5) is equipped with three passive contact semi-rings (16) (see FIGS. 9 and 12).

The application of such a vaporizer (embodiment 2) is the same as of vaporizer in embodiment 1.

When using a vaporizer, the heating of the tobacco stick (9) (embodiment 2) can be zoned—first use the lower part of the tobacco substrate in the sleeve of the tobacco stick (9), and then the upper part of the tobacco substrate in the sleeve of the tobacco stick (9).

After all the active substance is vaporized from the tobacco stick (9), the user opens the flip cover and removes the tobacco stick (9).

Thus, the vaporizer (embodiments 1, 2), provides easy installation of the tobacco stick (9) into the compound chamber (8) without its further deformation and without breaching the integrity of individual disposable resistive heaters (10), as well as allowing its easy and simple removal from the compound chamber (8) and accessible cleaning of the compound chamber (8) when the flip cover (5) is open.

FIG. 13 illustrates another embodiment of a vaporizer for smoking tobacco sticks comprising an individual heater with the flip cover open, featuring a flip cover (5') which rotates vertically about a horizontally provided hinge (6').

FIG. 14 illustrates yet another embodiment of a tobacco stick (9) comprising a visual indicator (19) for the removable installment of the tobacco stick (9) in the compound chamber (8) and two ring-like individual resistive heaters (heating elements) (18').

FIG. 15 illustrates a tobacco stick (9) in from the tobacco-containing end (9"). The special shape of the tobacco-containing end (9") is achieved by rolling or folding a metal foil resistance heater (18") into a roll together with the tobacco substrate (22), which allows to increase the contact area of the heater (18") with the tobacco substrate (22). The semi-rings (14) contact the contacts (23) of the tobacco stick (9), when the tobacco stick (9) is secured in the compound chamber (8) by closing the flip cover (5). The shape of the heater allows the device to use a lower temperature to completely heat the substrate.

FIG. 16 illustrates a first embodiment of the strip heater (18") for the tobacco stick (9) shown in FIG. 15, in unrolled, flattened perspective. The strip heater (18") can be implemented in two versions: a) with welded conductive contacts (23) made of more conductive metal than the heater as shown in FIG. 16, or b) only of resistive material with the ends (23) leading to one side as shown in a second embodiment in FIG. 17.

In case of using the strip heater (18") of type a), the heater (3) may be folded in half and a tobacco substrate (22) is laid between two halves. Also, a strip of tobacco substrate (22) is laid on top of an already folded heater (18"). After that, the entire packet is rolled in such a way that the heater contacts (23) are on the outside.

In case of using the strip heater (18") of type b), the tobacco material (22) is laid on the strip heater (18") and the resulting package is rolled up so that the contacts (23) are on the outside.

The tobacco substrate material (22) should be in the form of a strip.

FIG. 18 illustrates a third embodiment of the strip heater (18") for the tobacco stick (9), in unrolled, flattened perspective, consisting of a parallel grid connected to contact strips (23).

FIG. 19 illustrates a fourth embodiment of the strip heater (18") for the tobacco stick (9), in unrolled, flattened perspective, consisting of metal mesh (18") connected to contact strips (23).

FIG. 20 illustrates a schematic of the tobacco stick of the embodiment of FIG. 14 wherein each of the heating elements (18') is electrically connected to each of the two active contact semi-rings (14) of the presently disclosed vaporizer, thereby creating an electrical circuit comprising the heating elements (18'), conductive lines (15), electronic control and power unit (3), control button (4), and battery (2).

In embodiments 1 and 2, the vaporizer does not include a resistive heater other than the resistive heater (18) of the tobacco stick (9) to be provided in the compound chamber (8). In other embodiments, one or more penetrative and/or non-penetrative resistance heater(s) within the compound chamber may be used in addition to or instead of the resistive heater of the tobacco stick. The at least one resistive heater provided in the compound chamber may be configured to penetrate the tobacco stick to be provided within the compound chamber at least when the cover is in the closed position. The at least one resistive heater provided in the compound chamber may also be configured to surround at least a portion of the tobacco stick to be provided within the compound chamber at least when the cover is in the closed position For example, as shown in FIG. 21, penetrative resistive heaters (20) are provided in the compound chamber (8). When the tobacco stick (9) is inserted in the compound chamber (8) and the flip cover (5) is closed, the resistive heaters (20) penetrate the tobacco stick (9). In this embodiment, the tobacco stick (9) does not itself need a resistive heater. Penetrative resistive heaters (21) may also be provided in the flip cover (5).

As noted above, the heating element (18") may be part of a larger lattice structure.

FIG. 27 shows the heating element (18") as part of a conical, rolled lattice design with square shaped voids (24);

FIG. 28 shows the heating element (18") as part of a cylindrical lattice design, with uneven lattice thickness;

FIG. 29 shows the unrolled cylindrical lattice design of FIG. 28, with visible thickness variation on the front edge seen in perspective;

FIG. 30 shows the heating element (18") as part of a cylindrical lattice design with circular shaped voids (24);

FIG. 31 shows the cylindrical lattice design of FIG. 30, unrolled;

FIG. 32 shows the heating element (18") as part of a lattice design with circular voids (24). FIG. 32 shows the lattice design in its unrolled state with a partial enlarged view. A similar shape can be made with cups;

FIG. 33 shows the heating element (18") as part of a zig zag lattice design with optional square voids (24);

FIG. 34 shows the heating element (18") as part of a zig zag lattice design with optional circular voids (24); and FIG. 35 shows the heating element (18") as part of a cylindrical lattice rolled from the lattice of FIG. 32.

The above information confirms the possibility of industrial application of the claimed vaporizer for smoking cigarettes with an individual heater, which can be manufactured at any specialized enterprise.

The vaporizer can be widely used in smoking devices as it provides easy installation of cigarettes into the compound chamber without its deformation and without breaching the integrity of individual disposable resistive heaters, as well as easy and simple removal of cigarettes from the compound chamber and convenient cleaning of the tobacco cigarette substrate remains from the compound chamber after use.

All references herein to tobacco, are intended to to be understood to other botanicals, including inter alia cannabis and all cannabis derivatives, as well as botanicals other than tobacco or cannabis Similarly references to nicotine may be understand as references to cannabis derivatives, including inter alia THC and other cannabinoids, mutatis mutandis, as the inventors. Such cannabinoids may include, without limitation, delta 9 tetrahydrocannabinol (Delta 9 THC), iso-tetrahydrocannabinol (iso-THC), delta 9 tetrahydrocannabinolic acid (Delta (THCA), delta 8 tetrahydrocannabinol (Delta 8 THC), delta 8 tetrahydrocannabinolic acid (Delta 8 THCA), cannabidiol (CBD), cannabidiolic acid (CBDA), cannabinol (CBN), cannabinolic acid (CBNA), cannabinol methyl ether (CBNM), cannabinol-C4 (CBN-C4), cannabinol-CZ (CBN-C2), cannabiorcol (CBN-C1), cannabinodiol (CBND), cannabigerol (CBG), cannabigerolic acid (CBGA), cannabigerolic acid monomethyl ether (CBGAM), cannabigerol monomethyl ether (CBGM), cannabigerovarinic acid (CBGVA), cannabichromene (CBC), cannabichromanon (CBCN), cannabichromenic acid (CBCA), cannabichromevarin (CBCV), cannabichromevarinic acid (CB CVA), tetrahydrocannabivarin (THCV), cannabidivarin (CBDV), cannabielsoin (CBE), cannabielsoic acid A (CBEA-A), cannabielsoic acid B (CBEA-B), cannabigerovarin (CBGV), cannabidiolic acid (CBDA), cannabidiol monomethyl ether (CBDM), cannabidiol-C4 (CBD-C4), cannabidivarinic acid (CBDVA), and cannabidiorcol (CBD-C1), cannabicyclol (CBL), cannabicyclolic acid (CBLA), cannabicyclovarin (CBLV), cannabitriol, cannabitriolvarin (CBTV), ethoxy-cannabitriolvarin (CBTVE), cannabivarin (CBV), cannabidivarin (CBVD), cannabitriol, cannabitriolvarin (CBTV), ethoxy-cannabitiolvarin (CBTVE), cannabifuran (CBF), dehydrocannabifuran (DCBF), and cannabiripsol (CBR), β-caryophyllene epoxide; mentha-1,8(9)-dien-5-ol; pulegone; limonene; limonene oxide; α-terpinene; terpinen-4-ol; carvacrol; carvone; 1,8-cineole; p-cymene; fenchone; pulegone-1,2epoxide; β-myrcene; cannaflavin A; and cannaflavin B, or pharmaceutically acceptable salts thereof, solvates, metabolites, metabolic precursors, isomers or derivatives thereof.

In addition, it is expressly contemplated that the cigarette may combine tobacco and cannabis, tobacco and a non-cannabis, non-tobacco botanical, tobacco and one or more cannabinoids, nicotine and none or more cannabinoids. The cigarette may comprise a vitamin, pharmaceutical or other bioactive agent. Examples of non-tobacco and non-cannabis agents including, without limitation, caffeine, taurine, vitamin b12, vitamin c, and others.

Synthetic nicotine may be used in the cigarette; nicotine salts may be used in the cigarette.

EXAMPLES

Example A (Rolled Cigarette with Individual Heater Testing)

Supplies used in connection with the experiments for this example include a power supply, micrometric table, digital multimeter, Optris CT IR pyrometer, PT-100 thermosensor, vaping machine, special holder, control PCB, and a cigarette prototype.

The cigarette prototypes were made using a thin titanium foil that was cut into a shape similar to that of FIG. 16 that allowed for contacts on the outside of the cigarette prototype.

The thin titanium foil was rolled with reconstituted tobacco and place into a cigarette tube such that the foil-reconstituted tobacco roll was inside the cigarette tube and the cigarette prototype had contacts on the outside of the cigarette tube.

The tube was placed into a special holder fashioned to form compound chamber, made from a heat resistant material, and with powered electrical contacts in the compound chamber.

A number of different heating algorithms were planned for testing.

Preheating plus puff-heating. With this algorithm, heater preheats stick to a preheat temperature. During each puff, the temperature rises fast from the preheat temperature to working temperature producing vapor. Our intended ranges for this included a preheat temperature in the range 80-150C° and working temperature (during puffs) of 260-280C°.

Puff heating only (i.e. without preheating). With this algorithm, the heater starts heating instantly at the start of the puff and reach to work temperature in milliseconds. After the end of the puff its cool down. Our goal was a working temperature (during puffs) of 260-280C°.

Preheating and holding temperature. Preheating to the working temperature and holding this temperature during the full session. Our goal was a working temperature (holding) of 260-280C°. The prototype was connected through a special holder/compound chamber to the power supply. Also, the prototype was connected to a vaping machine to make standard Coresta (Method 81-June 2015) method puffs.

We first tested puff heating only (no preheating).

When the prototype was powered with a 4.2 v power supply, the tested heater design heated up too slowly. Using 8 v we got fast and rapid heating or instant heating to the working temperatures and got a vapor. The results of this testing are shown in FIGS. 22 and 23.

FIG. 22 shows the temperature across time, and shows the (decline) and rise in temperature associated with each puff. The decline and trough is associated with cooling caused by the commencement of the puff; the puff only heating cycle then cycles up the temperature FIG. 23 shows, for the same experiment, the puff timing.

The results show rising temperature puff to puff, and at the same time a strong vapor output was achieved. However, it is noted that the heat signature stabilizes with later puffs, and initial puffs were underpowered. This pointed to the need for some design optimization necessary to achieve more consistent puff temperatures, which may be achieved through improved heater performance, improved power design, and/or product formulation designed to accommodate for some temperature variability (e.g. see discussion supra concerning the lattice, and the use of areas of the tobacco composition than others for rapid aerosolization, e.g. areas of different tobacco thickness).

The strength of vapor production is seen in FIG. 24. In this figure, we see 8000 standard units of vapor density from the prototype; this compares with 7000 standard units generated by an IQOS device with a HEET when used in accordance with CORESTA methods and standard use instructions. This validates the vapor production output from embodiments of the present invention.

Next, we tested preheating plus puff heating. Results of this protocol are seen in FIGS. 25 and 26.

FIG. 25 shows the temperature across time, and shows the (decline) and rise in temperature associated with each puff. The decline and trough is associated with cooling caused by the commencement of the puff; the puff heating (in addition to the pre-heating) then cycles up the temperature. FIG. 26 shows, for the same experiment, the puff timing. FIG. 26 shows PWM quantitative value, in its essence being the power supplied to the heater in the rolled stick. The numerical value of PWM 800 on the graph corresponds to 100% power supplied to the heater during making a puff; during the following puffs the numerical value equals to 345, which corresponds to 43% of the power supplied to the heater.

As will be noted reviewing FIG. 25, preheating plus puff heating generated more consistent temperatures than puff heating only. Peak to trough heat differential (i.e. coldest puff temperature to warmest puff temperature) was approximately 100C. It was noted with product optimization this peak to trough heat differential could be substantially narrowed and reduced.

LIST OF REFERENCE NUMERALS

1. Body
2. Battery
3. Electronic control and power unit
4. Control button
5. Flip cover
6. Flip cover hinges
7. Flip cover retainer
8. Compound chamber
9. Tobacco stick with individual resistive heaters
10. Individual resistive heaters of the cigarette
11. Body part of the chamber in the body of the vaporizer
12. part of the chamber in the flip cover of the vaporizer
13. Longitudinal air ducts of the fixed and movable parts of the chamber
14. Active contact semi-rings of the fixed part of the chamber
15. Conductive lines
16. Passive contact semi-rings of the movable part of the chamber
17. Contact rings of the individual resistive heater of the cigarette
18. Heating surface
19. visual indicator
20. penetrative resistive heaters
21. penetrative resistive heaters in flip cover
22. tobacco substrate
23. Contacts
24. Voids in lattice structure.

What is claimed is:

1. A vaporizer configured to be used for vaping a botanical stick comprising at least one individual resistive heater configured to heat the botanical stick to a temperature sufficient to vaporize a substance in the botanical stick and resistive heater contacts to the at least one resistive heater, at least a portion of the botanical stick having the resistive heater contacts to be provided within the vaporizer; the vaporizer comprising:

a housing;

a battery compartment configured to hold a battery in the housing;

an electronic control and power unit provided in the housing; and a cover movable between an open position exposing a compound chamber within the housing and a closed position connected to the housing and forming a portion of the compound chamber, the compound chamber being configured, with the cover in the closed position, to directly contact and hold at least the portion of the botanical stick having the resistive heater contacts; the compound chamber comprising compound chamber contacts in the compound chamber configured to create an electrical connection between the electronic control and power unit and resistive heater contacts on the botanical stick when the botanical stick has been inserted into the compound chamber and the cover is in the closed position, and wherein, when the cover is in the closed position, a portion of the botanical stick protrudes from the compound chamber and is configured to be in that position during use or an inhalation state of the vaporizer.

2. The vaporizer of claim 1, wherein the vaporizer does not include a resistive heater other than the at least one individual resistive heater of the botanical stick to be provided in the compound chamber.

3. The vaporizer of claim 1, wherein further comprising a latch to maintain the cover in the closed position.

4. The vaporizer of claim 1, wherein the cover has a hinge about which the cover is rotated between the open position and the closed position.

5. The vaporizer of claim 1, wherein the electronic control and power unit is configured to provide a warm-up cycle of less than 4 seconds.

6. The vaporizer of claim 1, wherein the electronic control and power unit is configured to heat the at least one resistive heater in the botanical stick only during a puff.

7. The vaporizer of claim 1, wherein the compound chamber and the botanical stick to be provided therein have an equal diameter.

8. The vaporizer of claim 1, wherein the compound chamber has a diameter that is less than a diameter of the botanical stick to be provided therein.

9. The vaporizer of claim 1, wherein the compound chamber has a diameter that is greater than that of the botanical stick to be provided therein.

10. The vaporizer of claim 1, wherein the botanical stick and the at least one individual resistive heater are disposable.

11. The vaporizer of claim 1, wherein the cover comprises air ducts.

12. A vaporizer configured to be used for vaping a botanical stick to be provided within the vaporizer; the vaporizer comprising:

a housing;

a battery compartment configured to hold a battery in the housing;

an electronic control and power unit provided in the housing;

a cover movable between an open position exposing a compound chamber within the housing and a closed position connected to the housing and forming a portion of the compound chamber, the compound chamber configured to hold at least the portion of the botanical stick; and at least one resistive heater provided in the compound chamber and electrically connected to the electronic control and power unit, the resistive heater being configured to directly contact the botanical stick when the botanical stick has been inserted into the compound chamber at least when the cover is in the closed position and to heat the botanical stick to a temperature sufficient to vaporize a substance in the botanical stick, and wherein, when the cover is in the closed position, a portion of the botanical stick protrudes from the compound chamber and is configured to be in that position during use or an inhalation state of the vaporizer.

13. The vaporizer of claim 12, wherein the at least one resistive heater comprises pins.

14. The vaporizer of claim 13, wherein the pins are configured to penetrate the botanical stick to be provided within the compound chamber at least when the cover is in the closed position.

15. The vaporizer of claim 12, wherein the at least one resistive heater is configured to penetrate the botanical stick to be provided within the compound chamber at least when the cover is in the closed position.

16. The vaporizer of claim 12, wherein the at least one resistive heater provided in the compound chamber is configured to surround at least a portion of the botanical stick to be provided within the compound chamber at least when the cover is in the closed position.

* * * * *